US008814342B2

(12) United States Patent
Usuda et al.

(10) Patent No.: US 8,814,342 B2
(45) Date of Patent: Aug. 26, 2014

(54) FLUID EJECTING APPARATUS AND FLUID EJECTING METHOD

(75) Inventors: Hidenori Usuda, Matsumoto (JP); Mitsuaki Yoshizawa, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 13 days.

(21) Appl. No.: 13/186,262

(22) Filed: Jul. 19, 2011

(65) Prior Publication Data

US 2012/0019579 A1 Jan. 26, 2012

(30) Foreign Application Priority Data

Jul. 21, 2010 (JP) ..... 2010-164266
Mar. 23, 2011 (JP) ..... 2011-064772

(51) Int. Cl.
*B41J 2/01* (2006.01)

(52) U.S. Cl.
USPC ..... 347/101; 347/102; 347/14

(58) Field of Classification Search
USPC ..... 347/5, 9, 12, 19, 102, 101, 14
See application file for complete search history.

(56) References Cited

U.S. PATENT DOCUMENTS 5,725,961 A 3/1998 Ozawa et al.
6,114,411 A 9/2000 Nakamura et al.
7,015,259 B2 3/2006 Kataoka et al.
7,211,132 B2 5/2007 Oki et al.
7,244,021 B2 7/2007 Arai
7,407,277 B2 * 8/2008 Yoneyama ..... 347/102
7,740,695 B2 6/2010 Kitamura et al.
2004/0252173 A1 * 12/2004 Ben-Zur et al. ..... 347/101
2010/0066780 A1 * 3/2010 Akatsuka ..... 347/14

FOREIGN PATENT DOCUMENTS

JP 09-099634 A 4/1997
JP 09-2085870 A 8/1997
JP 2002-038063 A 2/2002
JP 2003-292834 A 10/2003
JP 2004-306591 A 11/2004
JP 2005-105135 A 4/2005
JP 2008-081693 A 4/2008
JP 2009-000925 A 1/2009
JP 2009-137124 A 6/2009
JP 2009-138078 A 6/2009

* cited by examiner

*Primary Examiner* — Lam S Nguyen
(74) *Attorney, Agent, or Firm* — Kilpatrick Townsend & Stockton LLP

(57) ABSTRACT

An apparatus includes: a main image nozzle group that forms a main image; a background image nozzle group which has nozzles of a number greater than the main image nozzle group for forming a background image of the main image, and has a first nozzle group situated to one side in a predetermined direction; and a second nozzle group situated to the other side in the predetermined direction, ejects fluid from the main image nozzle group to a first region on which the main image is formed on the medium to form dots, forms dots formed by ejecting fluid from the first nozzle group and dots formed by ejecting fluid from the second nozzle group, in a second region on which an image is formed using fluid forming the background image on the medium and the main image is not formed.

16 Claims, 14 Drawing Sheets

FLUID EJECTING APPARATUS AND FLUID EJECTING METHOD

Priority is claimed under 35 U.S.C. §119 to Japanese Application No. 2010-164266 filed on Jul. 21, 2010 and No. 2011-064772 filed on Mar. 23, 2011 which are hereby incorporated by reference in its entirety.

BACKGROUND

1. Technical Field

The present invention relates to fluid ejecting apparatus and a fluid ejecting method.

2. Related Art

As one type of fluid ejecting apparatus, an ink jet printer (hereinafter, referred to as a printer) having a head that ejects ink from nozzles to a medium is known. Among the printers, there is a printer that prints a main image and the background image becoming a background thereof. For example, in the case of a printer that uses white ink in addition to a color ink, it is possible to print the main image using the color ink to overlap the background image using the white ink (for example, see JP-A-2002-38063). As a result, it is possible to print an image having an excellent coloring property without being affected by the background color of the medium.

Normally, in the background image, ink is applied without any gap. For that reason, when an ejection defect occurs in the nozzles that print the background image, in a background image portion that does not overlap with the main image, a region to be printed by the nozzle with the ejection defect is conspicuous, whereby the image quality of the background image deteriorates.

SUMMARY

An advantage of some aspects of the invention is to suppress deterioration in the image quality of the background image.

According to an aspect of the invention, there is provided a fluid ejecting apparatus that has a main image nozzle group which is a predetermined number of nozzles that ejects fluid forming a main image on a medium; a background image nozzle group which has nozzles of a number greater than the predetermined number for ejecting fluid forming a background image of the main image on the medium, and has a first nozzle group situated to one side in a predetermined direction, and a second nozzle group situated to the other side in the predetermined direction; and a control portion which forms an image by ejecting fluid from the nozzles to each pixel defined on the medium to form dots, ejects fluid from the main image nozzle group to the pixels belonging to a first region on which the main image is formed on the medium to form dots, and forms dots formed by ejecting fluid from the first nozzle group and dots formed by ejecting fluid from the second nozzle group, in a second region on which an image is formed using fluid forming the background image on the medium and the main image is not formed.

Other aspects of the invention will be clarified by the descriptions of the present specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Disclosure Overview

Figure 1:
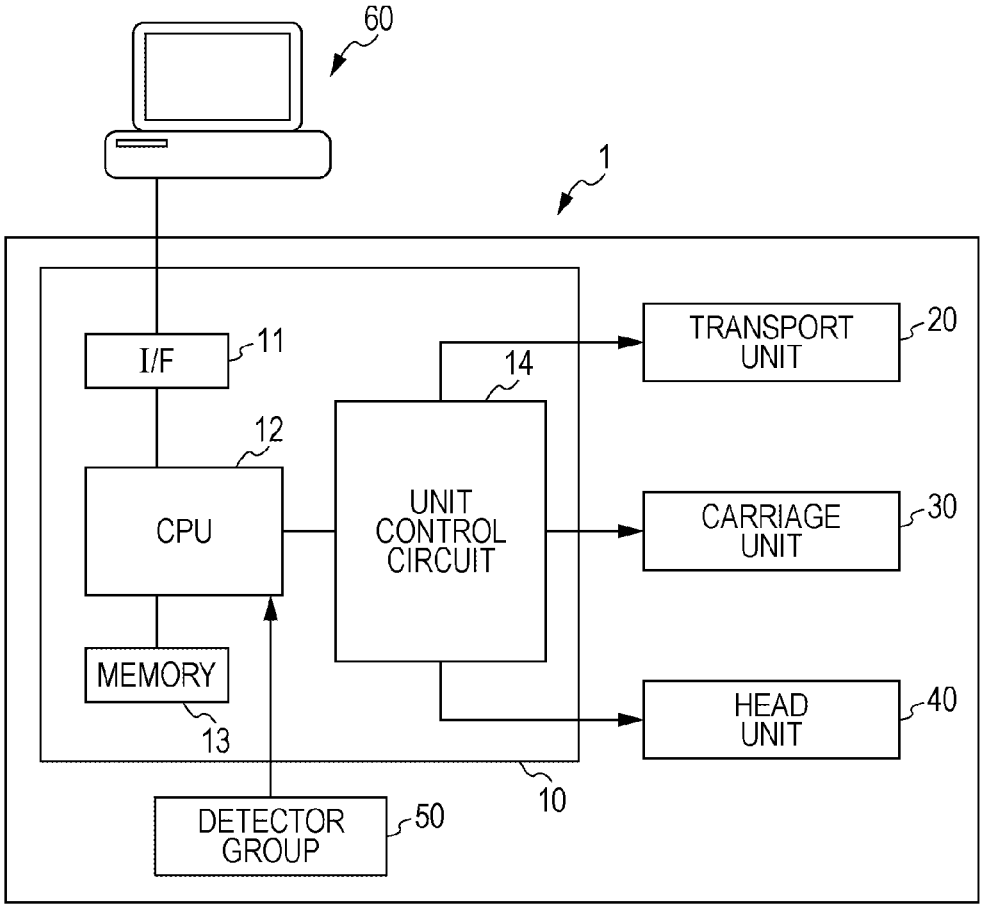
FIG. 1 is an overall configuration block diagram of a printer.

At least the following shall be clarified through the description of the specification and the description of the accompanying drawings.

That is, a fluid ejecting apparatus includes a main image nozzle group which is a predetermined number of nozzles for ejecting fluid forming a main image on a medium; a background image nozzle group which has nozzles of a number greater than the predetermined number for ejecting fluid forming a background image of the main image on the medium, and has a first nozzle group situated to one side in a predetermined direction, and a second nozzle group situated to the other side in the predetermined direction; and a control portion which forms an image by ejecting fluid from the nozzle to each pixel defined on the medium to form dots, ejects fluid from the main image nozzle group to the pixel belonging to a first region forming the main image on the medium to form dots, and forms dots formed by ejecting fluid from the first nozzle group and dots formed by ejecting fluid from the second nozzle group, in a second region which forms an image using fluid forming the background image on the medium and does not form the main image.

According to such a fluid ejecting apparatus, it is possible to suppress deterioration in the image quality of an image due to fluid forming the background image.

In such a fluid ejecting apparatus, fluid may be ejected from the first nozzle group to a part of the pixels belonging to the second region to form dots, and fluid may be ejected from the second nozzle group to another part of the pixels belonging to the second region to form dots.

According to such a fluid ejecting apparatus, it is possible to suppress deterioration in the image quality of an image due to fluid forming the background image.

In the fluid ejecting apparatus, when forming the main image and the background image to overlap on the medium, in order to form a background image portion that is the background image of the first region and overlaps with the main image, fluid may be ejected from one nozzle group of the first nozzle group and the second nozzle group to the pixel belonging to the first region to form dots.

According to such a fluid ejecting apparatus, it is possible to form the main image to overlap with the background image.

The fluid ejecting apparatus may have a first nozzle row in which the nozzles for ejecting fluid forming the main image are aligned in the predetermined direction and which has the main image nozzle group; and a second nozzle row in which the nozzles for ejecting fluid forming the background image are aligned in the predetermined direction, and which is aligned with the first nozzle row in a movement direction that is a direction of intersecting the predetermined direction, and has the first nozzle group and the second nozzle group, wherein an image is formed by repeating a dot forming operation of ejecting fluid from the nozzles while relatively moving the first nozzle row, the second nozzle row and the medium in the movement direction, and a transport operation of transporting a relative position of the medium relative to the first nozzle row and the second nozzle row to the other side of the predetermined direction, and wherein the dot forming operation of ejecting fluid from the first nozzle group to a part of the pixels belonging to the second region is different from the dot forming operation of ejecting fluid from the second nozzle group to another part of the pixels belonging to the second region.

According to such a fluid ejecting apparatus, it is possible to suppress deterioration in the image quality due to transport errors.

In the fluid ejecting apparatus, in the case of forming the main image and the background image to overlap on the medium, in a first mode of forming the background image before the main image in the predetermined region of the medium, the main image may be formed by the main image nozzle group which is the nozzles of the first nozzle row aligned with the second nozzle group in the movement direction, and the background image of the first region may be formed by the first nozzle group, and in the second mode of forming the main image before the background image in the predetermined region of the medium, the main image may be formed by the main image nozzle group which is the nozzles of the first nozzle row aligned with the first nozzle group in the movement direction, and the background image of the first region may be formed by the second nozzle group.

According to such a liquid ejecting apparatus, the main image and the background image can be formed to overlap in order according to the mode, and the dot forming operation of forming the main image and dot forming operation of forming the background image of the first region can be made different from each other, whereby the drying time can be lengthened.

In the fluid ejecting apparatus, in the first mode, fluid may be ejected from the nozzles of the first nozzle row aligned with the first nozzle group in the movement direction to a part of the pixels belonging to the second region to form dots, fluid may be ejected from the main image nozzle group to another part of the pixels belonging to the second region to form dots, and in the second mode, fluid may be ejected from the main image nozzle group to a part of the pixels belonging to the second region to form dots, and fluid may be ejected from the nozzles of the first nozzle row aligned with the second nozzle group in the movement direction to another part of the pixels belonging to the second region to form dots.

According to such as fluid ejecting apparatus, the dots formed by the nozzles of the first nozzle row can be mixed with the dots formed by the nozzles of the second nozzle row, which can improve the granular quality in the background image.

In the fluid ejecting apparatus, fluid may be ejected from one nozzle group of the first nozzle group and the second nozzle group to the pixels which form the background image and are situated around the pixels belonging to the first region.

According to such a fluid ejecting apparatus, it is possible to prevent the main image dots and the background image dots from being mixed with each other, which can prevent bleeding of the image.

In the fluid ejecting apparatus, the dots formed by ejecting fluid from the first nozzle group and the dot formed by ejecting fluid from the second nozzle group may be formed to overlap in the pixel belonging to the second region.

According to such a fluid ejecting apparatus, it is possible to form at a high density the image formed by the fluid forming the background image.

Furthermore, according to another aspect of the invention, there is provided a liquid ejecting method in which a fluid ejecting apparatus ejects fluid from nozzles to each pixel defined on a medium, the fluid ejecting apparatus including a main image nozzle group which is a predetermined number of nozzles for ejecting fluid forming a main image on the medium; a background image nozzle group which has nozzles of a number greater than the predetermined number for ejecting fluid forming a background image of the main image on the medium, and has a first nozzle group situated to one side in a predetermined direction, and a second nozzle group situated to the other side in the predetermined direction, the method including ejecting fluid from the main image nozzle group to the pixel belonging to the first region forming the main image on the medium; ejecting fluid from the first nozzle group to a part of the pixels belonging to a second region which forms an image using fluid forming the background image on the medium and does not form the main image; and ejecting fluid from the second nozzle group to another part of the pixels belonging to the second region.

According to such a fluid ejecting method, deterioration of the image quality of the background image can be suppressed.

Print System

Hereinafter, an embodiment of a print system will be described as an example in which a fluid ejecting apparatus is used as an ink jet printer (hereinafter, referred to as a printer), and the printer is connected to a computer.

Figure 2:
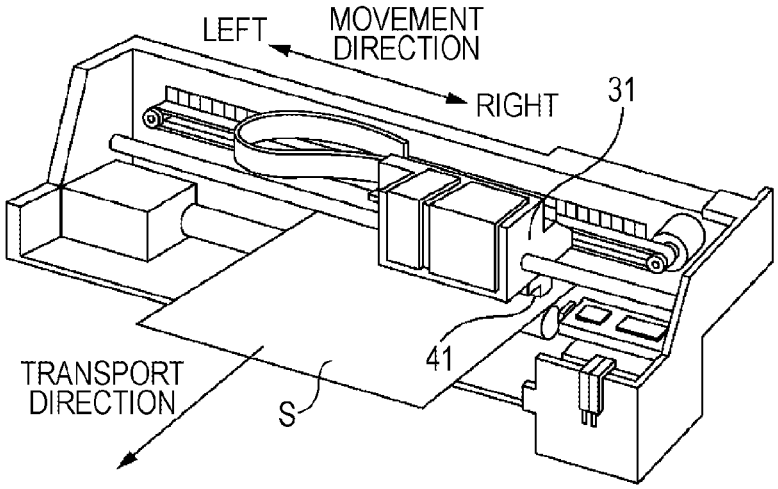
FIG. 2 is a perspective view of the printer.

FIG. 1 is an overall configuration block diagram of a printer 1. FIG. 2 is a perspective view of the printer 1. A computer 60 is connected to the printer 1 in a communicatable manner, and outputs printing data to the printer 1 in order to print an image by the printer 1. In addition, a program (printer driver) for converting the image data output from an application program to the printing data is installed in the computer 60. The printer driver is stored in a storage medium (storage medium readable by the computer) such as a CD-ROM or can be downloaded to the computer via the Internet.

A controller 10 is a control unit for performing the control of the printer 1. An interface portion 11 is for performing the transmission and reception of the data between the computer 60 and the printer 1. A CPU 12 is an arithmetic processing unit for performing the control of the entire printer 1. A memory 13 is for securing a region storing the program of the CPU 12, a working region or the like. The CPU 12 controls each unit by a unit control circuit 14. In addition, a detector group 50 monitors the situation in the printer 1, and the controller 10 controls each unit based on the detection result.

A transport unit 20 transports a medium S to a printable position, and transports the medium S in the transport direction by a predetermined transport amount during printing.

A carriage unit 30 moves a head 41 in a movement direction intersecting the transport direction and has a carriage 31.

A head unit 40 ejects ink to the medium S and has the head 41. The head 41 is moved in the movement direction by the carriage 31. A plurality of nozzles as an ink ejection portion is provided on the lower surface of the head 41, and a pressure chamber (not shown) into which ink enters is provided at each nozzle.

Figure 3:
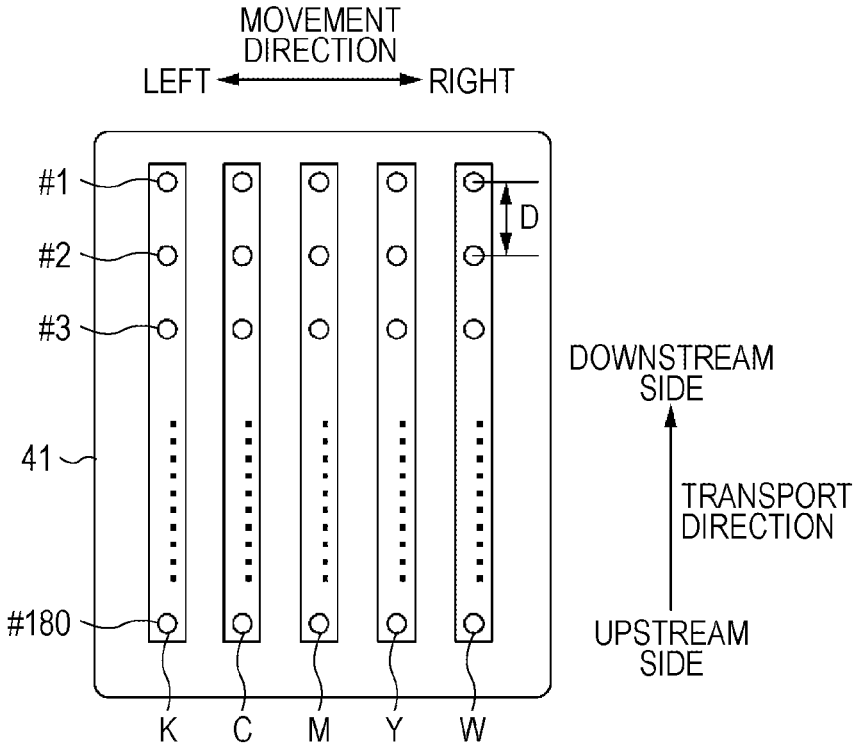
FIG. 3 is a diagram that shows an arrangement of nozzles provided on a lower surface of a head.

FIG. 3 is a diagram that shows an arrangement of nozzles provided on the lower surface of the head 41. In addition, FIG. 3 is a diagram that virtually shows the nozzles from the upper surface of the head 41. On the lower surface of the head 41, five nozzle rows are formed in which 180 nozzles are aligned in the transport direction at predetermined distances D. As shown, a black nozzle row K ejecting black ink, a cyan nozzle row C ejecting cyan ink, a magenta nozzle row M ejecting magenta ink, a yellow nozzle row Y ejecting yellow ink, and a white nozzle row W ejecting white ink are aligned in the movement direction. In addition, small numbers (#1 to #180) are added in order from the nozzles on the downstream side of the transport direction to the 180 nozzles included in each nozzle row.

In such a printer 1, a dot forming operation of intermittently ejecting ink droplets from the head 41 moving along the movement direction to form dots on the medium, and a transport operation of transporting the medium to the head 41 in the transport direction are repeated. In so doing, the dots can be formed in the later dot forming operation, at a position on the medium different from the position of the dots formed by the previous dot forming operation, whereby it is possible to print a two-dimensional image on the medium. In addition, an operation (one dot forming operation), in which the head 41 is moved in the movement direction once while ejecting ink droplets, is called a "pass".

Printing Mode

Figure 4:
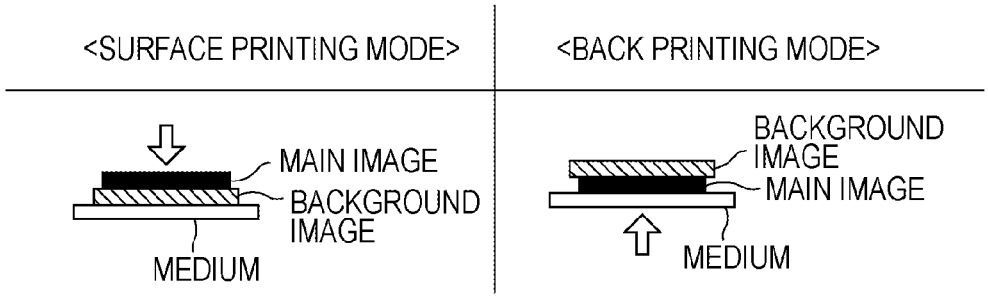
FIG. 4 is a diagram that describes a printing mode included in the printer.

FIG. 4 is a diagram that describes the printing mode of the printer 1 of the present embodiment. The printer 1 of the present embodiment forms printed matters in which a main image (a color or monochrome image) printed by the use of at least one of nozzle rows (CMYK) of four color inks and a white background image printed by the use of white nozzle row W are overlapped. By providing the white background image in the background of the main image, particularly, when the medium is not white, an image having excellent coloring property can be printed. Furthermore, when the medium is transparent, by printing the main image and the background image to overlap, it is possible to prevent the opposite side of the printed matter becoming transparent.

In addition, when printing the background image using only the white ink, the color itself of the white ink becomes the color of the background image. However, even in inks similarly called white ink, the colors of white differ slightly from each other depending on the material or the like of ink. For that reason, in some cases, a background image of a color different from the color desired by the user may be printed depending on the white ink to be used. Furthermore, a background image may be desired which has some chromatic color, not simple white. Thus, the printer 1 of the present embodiment suitably uses a small amount of four colors of ink (CMYK) together with the white ink to print a desired white background image (adjusted white background image). In so doing, on the contrary, when the white ink has some color, the background image may be printed together with ink erasing the color to make the background image close to an achromatic color. In addition, when the printer has a light shade ink (light cyan or light magenta), the light shade ink may be used in the adjustment of the color of the background image.

Moreover, the printing data for printing the background image suitably using the white ink and four color inks in the printer 1 may be stored by the printer 1 in advance, and in a case where the color of a desired background image is selected, for example, when a user sees the monitor of the printer 1 or the screen of the computer, the printer driver may create the printing data of the background image depending on the selected color.

Moreover, in the case of forming the printed matter in which the main image and the background image are overlapped with each other, the printer 1 forms the printed matter by any one mode of the "front printing mode" and the "back printing mode". The front printing mode is a mode of printing the image so that the main image is viewed from the printing surface side. For that reason, in the front printing mode, the background image is printed in a predetermined region of the medium in advance, and the main image is printed on the background image. Meanwhile, the back printing mode is a mode of printing the image so that the main image is viewed from the surface of a side opposite to the printing surface via the medium, and when the medium has transparency, the back printing mode is performed. In the back printing mode, the main image is printed in a predetermined region of the medium in advance, and the background image is printed on the main image.

Figure 5A:
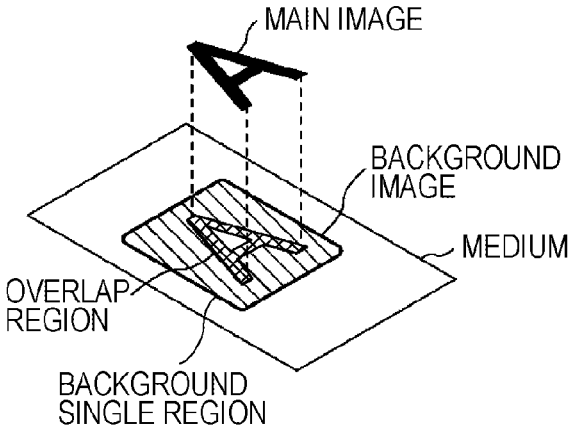
FIGS. 5A and 5B are diagrams that describe an overlap region and a background single region.
Figure 5B:
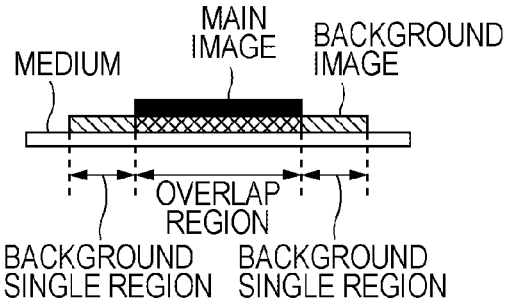

FIGS. 5A and 5B are diagrams that describe the overlap region and the background single region. FIGS. 5A and 5B show the main image and the background image printed in the front printing mode, FIG. 5A is a perspective view of the printed matter, and FIG. 5B is a cross-sectional view of the printed matter. For the following description, a region formed with the main image on the medium, that is a region where the main image and the background image are formed to overlap is called "an overlap region (corresponding to a first region)". Moreover, a region, where the background image (the image formed by the fluid forming the background image) is formed on the medium and the main image is not formed, is called "a background single region (corresponding to a second region)". In addition, the background image is not limited to the approximately rectangular shape shown in FIGS. 5A and 5B. For example, a letter A as the main image may be an edged background image, that is, a range of approximately several mm around the letter A may be the background image.

First Printing Pattern

Figure 6:
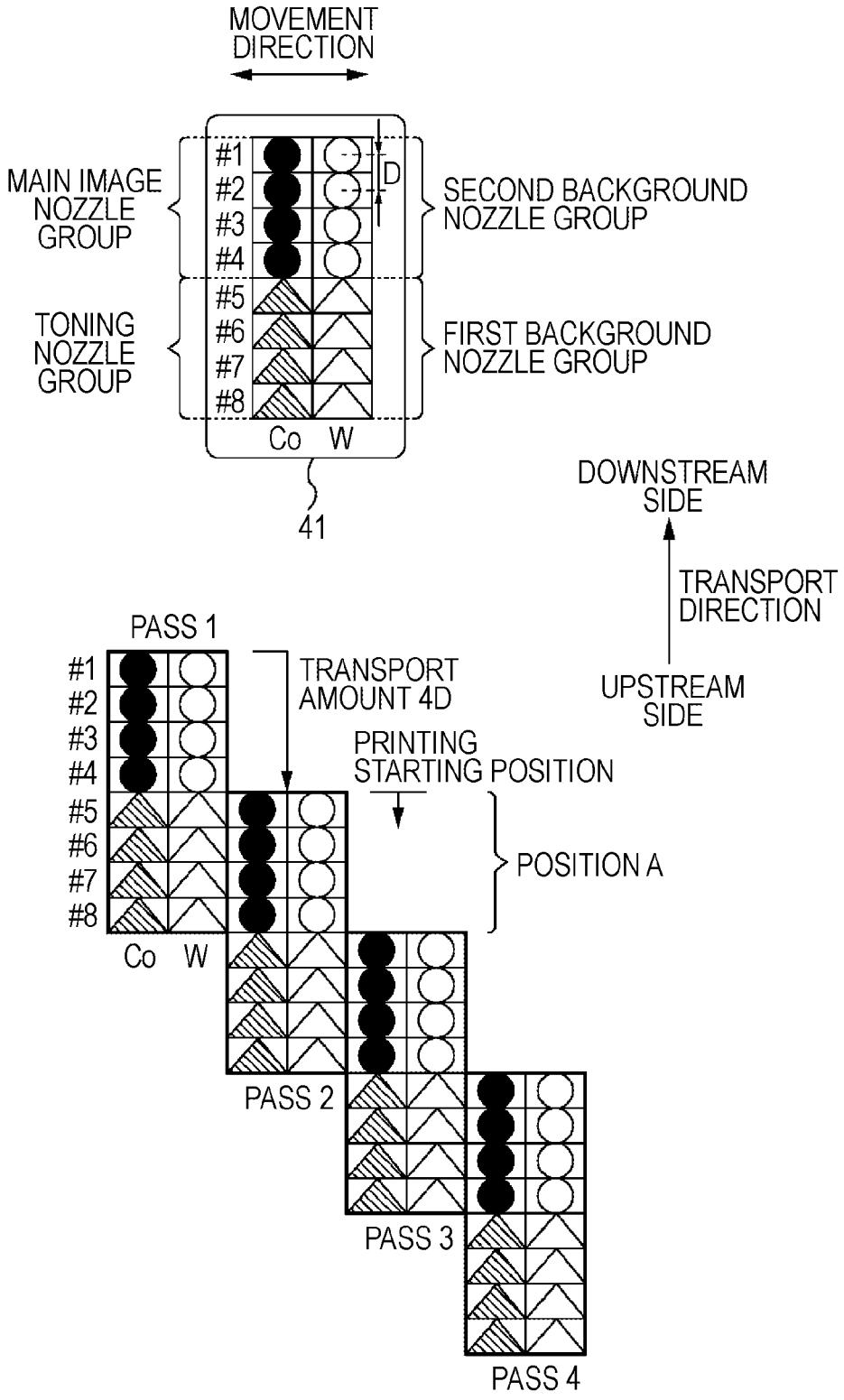
FIG. 6 is an explanatory diagram of a first print pattern in a front printing mode.

FIG. 6 is an explanatory diagram of a first printing pattern of the front printing mode. For simplicity of explanation in FIG. 6, the nozzle rows (CMYK) each ejecting the four color inks are collectively called "a color nozzle row Co". In FIG. 6, for simplicity of explanation, the numbers of the nozzles are further reduced or the medium transport amount is shortened compared to those of an actual printer. The numbers of the nozzles each belonging to the color nozzle row Co and the white nozzle row W are eight (#1 to #8), and the distance of the nozzles aligned in the transport direction in the nozzle row is D.

The top diagram of FIG. 6 is a diagram that shows nozzles used for printing each image. In the case of the front printing mode, half of the nozzles #1 to #4 of the color nozzle row Co on the downstream side of the transport direction are "a main image nozzle group" (black circular nozzles) for printing the main image, and half of the nozzles #5 to #8 of the color nozzle row Co on the upstream side of the transport direction are "a toning nozzle group" (diagonal triangular nozzles) for adjusting the color of white of the background image. Moreover, half of the nozzles #1 to #4 of the downstream side (corresponding to the other side in a predetermined direction) in the transport direction of the white nozzle row W are "a second background nozzle group (corresponding to the second nozzle group)" (white circular nozzles) for printing the background image, and half of the nozzles #5 to #8 of the upstream side in the transport direction of the white nozzle row W are "a first background nozzle group (corresponding to the first nozzle group)" (outlined triangular nozzles) for printing the same background image. Thus, the color nozzle row Co corresponds to the first nozzle row, and the white nozzle row W corresponds to the background image nozzle group and the second nozzle row. Furthermore, in FIG. 6, the number (predetermined number) of the nozzles constituting the main image nozzle group is four, and the number (greater than a predetermined number) of the nozzles constituting the background image nozzle group is eight.

The bottom diagram of FIG. 6 is a diagram that shows the position in the transport direction of the nozzles in each pass. Although the medium is transported to the transport direction downstream side to the head 41 in the actual printer 1, the lower diagram of FIG. 6 shows the state in which the head 41 is transported to the transport direction downstream side. The printing method shown in FIG. 6 is a band printing. The band printing is a printing method in which a band image formed in one pass is aligned in the transport direction and is a printing method in which, in a given pass, a raster line (dot rows along the movement direction is not formed between raster lines during another pass). Thus, in the band printing, one medium transport amount corresponds to a width length in the transport direction of the band image formed in the one pass.

In the first printing pattern, in the nozzle configuration shown in the upper diagram of FIG. 6, an operation of forming the image while moving the nozzle row (the head 41) in the movement direction, and an operation of transporting the medium to the transport direction downstream side by a half length (4D) of the nozzle row are repeated. In so doing, for example, firstly, the position A on the medium in the transport direction shown in the lower diagram of FIG. 6 faces the toning nozzle group and the first background nozzle group in pass 1. Thereafter, the medium is transported to the transport direction downstream side by the half length 4D of the nozzle row, whereby the position A on the medium in the transport direction faces the main image nozzle group in pass 2. As a consequence, in the position A on the medium in the transport direction, the main image can be printed on the background image.

Incidentally, the position A on the medium in the transport direction faces the second background nozzle group (○) as well as the main image nozzle group (●) in pass 2. The main image is printed on the background image of the overlap region, but the main image is not printed on the background image of the background single region. Thus, it is possible to form the dots of the background image of the background single region using the second background nozzle group in pass 2.

Accordingly, in the present embodiment, the main image is printed by the main image nozzle group, the background image (the background image of the overlap region) overlapped with the main image is printed by the first background nozzle group, and the background image (the background image of the background single region) not overlapped with the main image is printed by the first background nozzle group and the second background nozzle group. That is, the number of the nozzles (nozzles #1 to #8 of the white nozzle row W in FIG. 6) of white printing the background image of the background single region is greater than the number of the nozzles (nozzles #1 to #4 of the color nozzle row Co in FIG. 6) per color printing the main image. Furthermore, the number of the nozzles of white printing the background image of the background single region is greater than the number of the nozzles (nozzles #5 to #8 of the white nozzle row W in FIG. 6) of white of printing the background image of the overlap region.

Moreover, in the present embodiment, the raster line constituting the main image is formed by one nozzle belonging to the main image nozzle group in one pass, and the raster line constituting the background image of the overlap region is formed by one nozzle belonging to the first background nozzle in one pass. Conversely to this, the raster lines constituting the background image of the background single region are formed by two nozzles each belonging to the first background nozzle group and the second background nozzle group in two passes.

If the raster line constituting the background image of the background single region is formed by one nozzle, when the nozzle is a defective nozzle, a white stripe (banding) along the movement direction occurs on the background image. Usually, the background image is a solid image, and the white ink is applied so as to print the background image without gaps. For that reason, in the background image of the background single region, the white stripe due to the defective nozzle is easily noticeable as compared to the main image. Furthermore, even in the same background image, since the background image of the overlap region overlaps with the main image, as compared to the background image of the background single region, the white stripe due to the defective nozzle is hardly noticeable.

Accordingly, the printer 1 of the present embodiment carries out a printing method (fluid ejecting method) which ejects ink from the main image nozzle group to the pixel belonging to the overlap region to form dots so as to print the main image, ejects ink from the first background nozzle group to a part of the pixels belonging to the background single region to form dots so as to print the background image of the background single region, and ejects ink from the second background nozzle group to another part of the pixels belonging to the background single region to form dots. That is, the dots formed by ejecting ink from the first background nozzle group and the dots formed by ejecting ink from the second background nozzle group are formed on the background single region. In so doing, even when one nozzle of two nozzles forming the raster line constituting the background image of the background single region is the defective nozzle, the dots is formed by another nozzle. As a consequence, a white stripe due to the defective nozzle can made hardly noticeable, whereby deterioration in the image quality of the background image can be suppressed.

In addition, in a case where one or a plurality of nozzles capable of forming one raster line form the dots in the pixel of the position of the different movement direction in different passes, respectively, the number of nozzles or the number of passes forming the one raster line is defined as "an overlap number". Then, in the present embodiment, it is said that the overlap number printing the background image of the background single region is greater than the overlap number printing the main image and the background image of the overlap region.

Furthermore, if the raster line constituting the background image of the background single region is formed in one pass, when a transport error occurs in the transport operation before that pass, the position of the raster line in the transport direction deviates. Then, the gap of the raster line formed in the other pass in the transport direction deviates, and a stripe along the movement direction occurs on the background image.

Accordingly, in the present embodiment, in order to form the background image of the background single region, the pass of ejecting ink from the first background nozzle group to a part of the pixels belonging to the background single region is made differently from the pass of ejecting ink from the second background nozzle group to another part of the pixels belonging to the background single region. Thus, the background image of the background single region is formed by two passes including the transport operation therebetween. As a consequence, even when the position in the transport direction of the dots formed in one pass deviates due to the transport error, when the position in the transport direction of the dot formed in another pass is identical, deterioration in the image quality of the background image can be suppressed.

In conclusion, in the printer 1 of the present embodiment, in a case where the background image is printed before the main image in a predetermined region of the medium as in the front printing mode (the first mode), the first background nozzle group printing the background image is nozzles further to the upstream side in the transport direction than the main image nozzle group printing the main image. That is, the main image is formed by the main image nozzle group, which is the nozzles of the color nozzle row Co, aligned with the second background nozzle group on the downstream side of the transport direction in the movement direction, and the background image of the overlap region is formed by the first background nozzle group. In so doing, in a predetermined region of the medium, the pass where the background image of the overlap region is formed by the first background nozzle group can be made differently from the pass where the main image is printed by the main image nozzle group. As a consequence, in a predetermined region of the medium, it is possible to relatively lengthen the drying time from when the background image of the overlap region is printed to when the main image is printed, whereby bleeding of the image can be prevented.

Moreover, the second background nozzle group aligned with the main image nozzle group in the movement direction of the head 41 is used in the printing of the background image of the background single region that does not overlap with the main image. As a consequence, as mentioned above, it is possible to suppress deterioration in the image quality of the background image of the background single region due to the defective nozzle or the transport error. That is, in the present embodiment, the second background nozzle group aligned with the main image nozzle group in the movement direction is effectively used to print the background image of the background single region.

Furthermore, by printing the background image of the background single region using the second background nozzle group, all nozzles belonging to the white nozzle row W are used in the printing, whereby the deviation of frequency of use of the nozzle is suppressed, with the result that life expectancy of the head 41 can be lengthened. In addition, it is possible to prevent the clogging of ink due to disuse of the nozzle over an extended time, precipitation of color materials as ink components or the like, whereby deterioration in the image quality of the background image can be suppressed.

In addition, in the present embodiment, in order to adjust the white of the background image, the toning nozzle group aligned with the first background nozzle group in the movement direction of the head 41 is used in the printing. Therefore, since all the nozzles of the color nozzle row Co are used in the printing similarly to the white nozzle row W, it is possible to prevent the deviation of frequency of use of the nozzles, the clogging or the precipitation of the ink color materials.

Furthermore, a ratio of the color ink constituting the background image is smaller than that of the white ink. However, in order to reduce the granular quality of the color ink in the background image, it is desirable to uniformly disperse the dots of the color ink on the background image as far as possible. That is, the color ink density (dot density) per the unit region of the background image is made to be smaller than the white ink density (dot density) per the unit region of the background image. For this reason, as shown in FIG. 6, the number of nozzles belonging to the first background nozzle group may be set to be the same as that belonging to the toning nozzle group, and the dot formed by the toning nozzle group may be set as a dot of a small size. However, the nozzle belonging to the toning nozzle group number may be reduced further than the number of nozzles belonging to the first background nozzle group without being limited thereto.

Furthermore, in order to lengthen the drying time of the image to be printed in advance in a predetermined region of the medium, unused nozzles may be provided between the first background nozzle group and the main image nozzle group. In so doing, between the pass where the background image is printed in a predetermined region of the medium and the pass where the main image is printed, a pass (pass where the unused nozzles face the medium) can be provided where an image is not printed, whereby the drying time of the image can be further lengthened. Furthermore, the length of the transport direction to which the unused nozzle belongs may be a length of an integral multiple of the medium transport amount. In so doing, the pass number of the pass where the background image is printed and the pass where the main image is printed can be regularly set over the entirety of image regions, whereby a density irregularity of the image can be prevented.

Hereinafter, a specific printing method (a dot forming method) will be described.

Figure 7A:
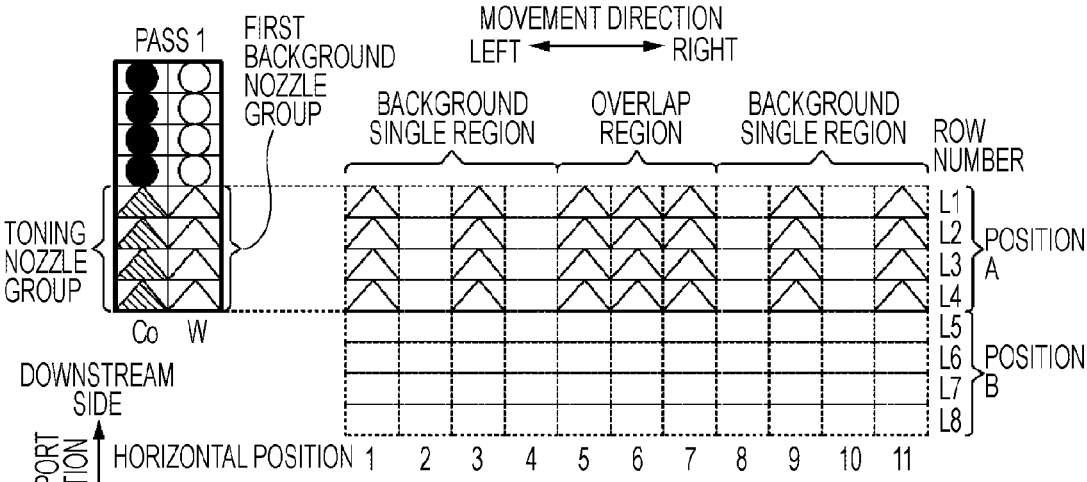
FIGS. 7A to 7C are diagrams that describe the positions of dots that are formed in the background single region and the overlap region, respectively.
Figure 7B:
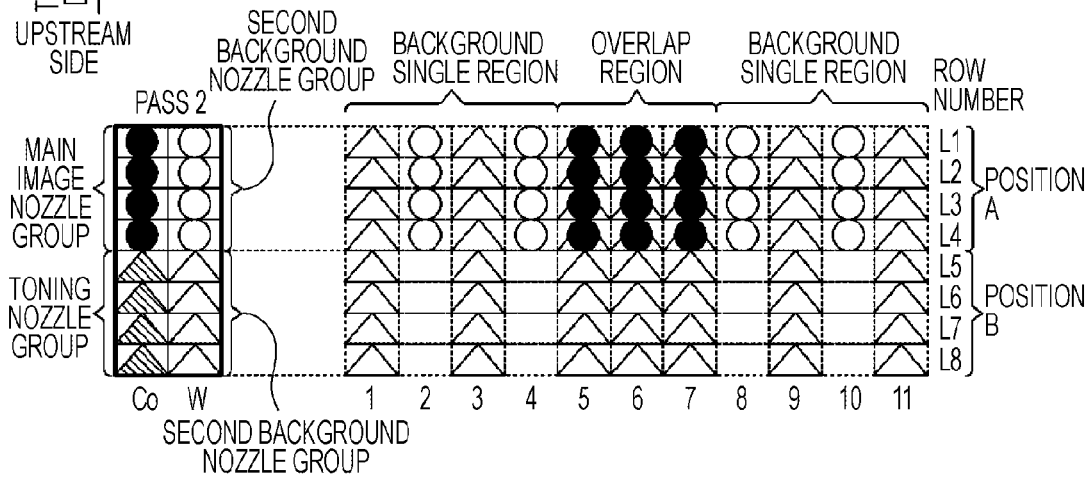
Figure 7C:
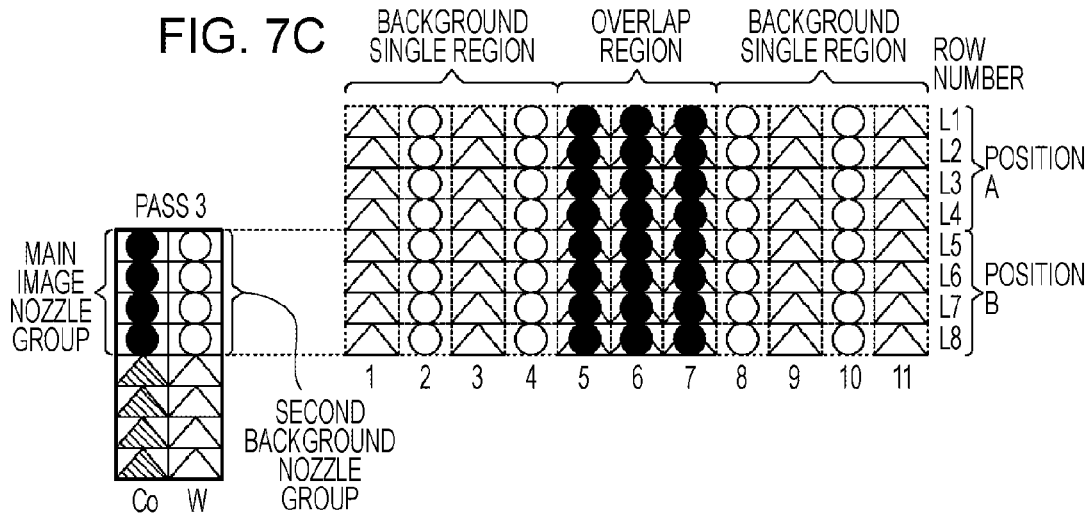

FIGS. 7A to 7C are diagrams that describe the positions of the dots formed in the background single region and the overlap region, respectively. In FIGS. 7A to 7C, squares of dotted-lines are called "pixels" which are unit regions on the medium formed with one dot. As the horizontal position, small numbers (1, 2, 3, . . . ) are successively given from the left pixels in the movement direction, and as a row number, small numbers (L1, L2, L3, . . . ) are successively given from the pixel of the downstream side in the transport direction. The pixels of horizontal positions 1 to 4 and 8 to 11 are pixels belonging to the "background single region", and the pixel of horizontal positions 5 to 7 are pixels belonging to the "overlap region". Furthermore, the pixels of row numbers L1 to L4 are pixels belonging to the region of the position A of the transport position, and the pixels of row numbers L5 to L8 are pixels belonging to the region of the position B in the transport direction.

In addition, in FIGS. 7A to 7C, the printing data is directed so as to form the dots in all the pixels. Furthermore, in the background image of the overlap region, the color of white is not adjusted by four color ink, but is formed only by white ink.

Thus, the dots formed by the toning nozzle group are formed only in the background single region. Furthermore, in FIGS. 7A to 7C, dots formed by the first background nozzle group are shown by "Δ (outlined triangle)" dots formed by the second background nozzle group are shown by "○ (white circle)", dots formed by the main image nozzle group are shown by "● (black circle), and dots formed by the toning nozzle group are not shown.

Firstly, in pass 1 shown in FIG. 7A, the first background nozzle group and the toning nozzle group faces the region of the position A on the medium in the transport direction. The first background nozzle group forms the dots (Δ) in the pixel belonging the position A and in the pixels belonging to the overlap region. Meanwhile, the first background nozzle group and the toning nozzle group forms the dots in all the pixel belonging to the region of the position A in the transport direction and in the pixels (1, 3, 9, and 11) having odd numbered horizontal positions among the pixels belonging to the background single region, and does not form the dots in the pixels (2, 4, 8 and 10) having even numbered horizontal positions.

Next, when the medium is transported to the transport direction downstream side by a half length of nozzle row, as shown in FIG. 7B, the main image nozzle group and the second background nozzle group face the region of the position A on the medium in the transport direction, and the toning nozzle group and the first background nozzle group face the region of the position B in the transport direction on the medium. The toning nozzle group and the first background nozzle group facing the region of the position B in the transport direction form the dot, similarly to FIG. 7A. Moreover, the main image nozzle group forms the dot (●) in the pixel belonging to the region of the position A in the transport direction, and in all the pixels belonging to the overlap region. Meanwhile, the second background nozzle group forms the dot (○) in the pixel belonging to the region of the position A in the transport direction, and in the pixel having the even numbered horizontal position among the pixels belong to the background single region, and does not form the dots in the pixel having the odd numbered horizontal position.

After that, when the medium is transported to the downstream side in the transport direction by a half length of the nozzle row, as shown in FIG. 7C, the main image nozzle group and the second background nozzle group face the region on the medium of the position B in the transport direction. Moreover, the main image nozzle group and the second background nozzle group form the dots (● and ○) similarly to FIG. 7B.

As a consequence, the raster line constituting the main image is formed by one nozzle belonging to the main image nozzle group in one pass, and the raster line constituting the background image of the overlap region is formed by one nozzle belonging to the first background nozzle group in one pass. On the contrary to this, the raster line constituting the background image of the background single region is formed by two nozzles each belonging to the first background nozzle group and the second background nozzle group in two passes. Therefore, even when the defective nozzle is generated in the nozzles which were allocated so as to print the background image of the background single region, deterioration in the image quality of the background image of the background single region can be prevented.

Figure 8:
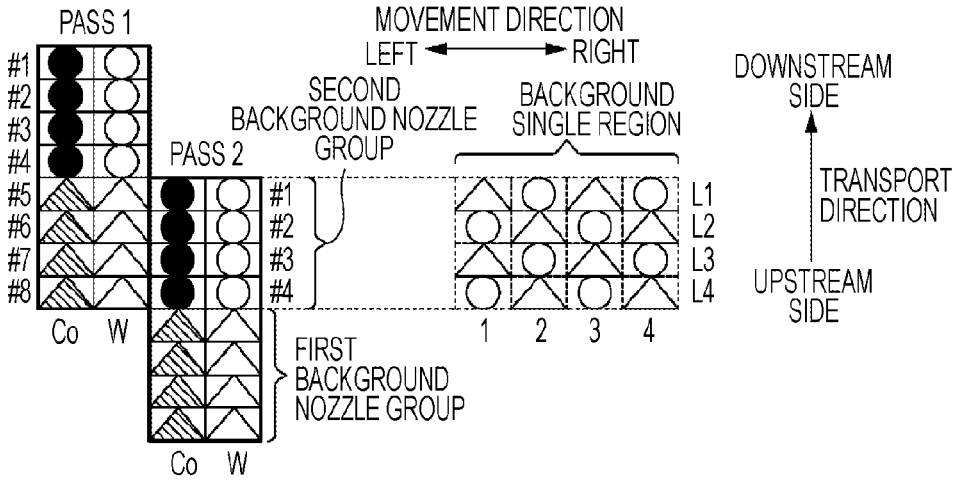
FIG. 8 is a diagram that shows another example of a dot position that is formed in the background single region.

FIG. 8 is a diagram that shows another example of the dot positions formed in the background single region. In the dot forming positions shown in FIGS. 7A to 7C, the dot (Δ) by the first background nozzle group is formed in the pixel having the odd numbered horizontal position, and the dot (○) by the second background nozzle group is formed in the pixel of the even numbered horizontal position. For that reason, the dots to be formed in the same pass are aligned in the transport direction over the half width length of the nozzle row.

However, the dots aligned in the transport direction may be formed by the nozzles belonging to another nozzle group without being limited thereto. In order to do so, for example, as shown in FIG. 8, in pass 1, the nozzles #5 and #7 of the first background nozzle group (Δ) form the dots in the pixel having odd numbered horizontal positions, and the nozzles #6 and #8 of the first background nozzle group (Δ) form the dots in the pixel having even numbered horizontal positions. Moreover, in pass 2, the nozzles #1 and #3 of the second background nozzle group (○) form the dots in the pixel having even numbered horizontal positions, and the nozzles #2 and #4 of the second background nozzle group (○) form the dots in the pixel having even numbered horizontal positions.

For example, pass 1 is an outward path operation where the head 41 is moved to one side in the movement direction, and pass 2 is a return path operation where the head 41 is moved to the other side in the movement direction. In some cases, by a property difference between the outward path and the return path, the dot forming position of the outward path and the dot forming position of the return path deviate from each other in the movement direction. In this case, similarly to the printing method of FIG. 8, the dots (Δ) formed in the pass 1 as the outward path and the dots (○) formed in the pass 2 as the return path are alternately aligned in the transport direction and the movement direction, whereby the difference between the dot forming positions of the outward path and the return path can hardly be noticeable.

Figure 9A:
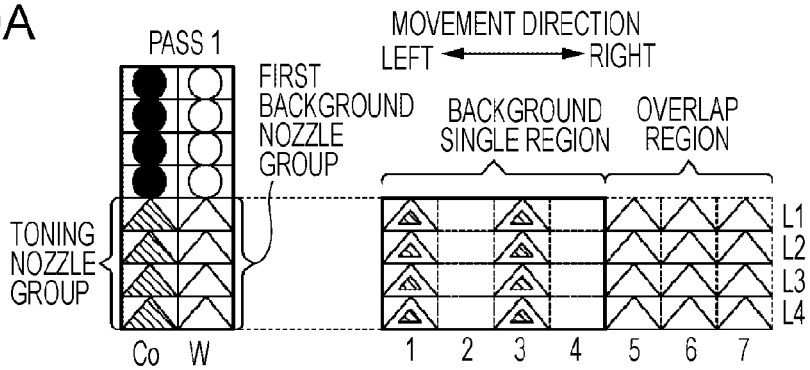
FIGS. 9A and 9B are diagrams that show another forming method of forming a toning dot of the background image.
Figure 9B:
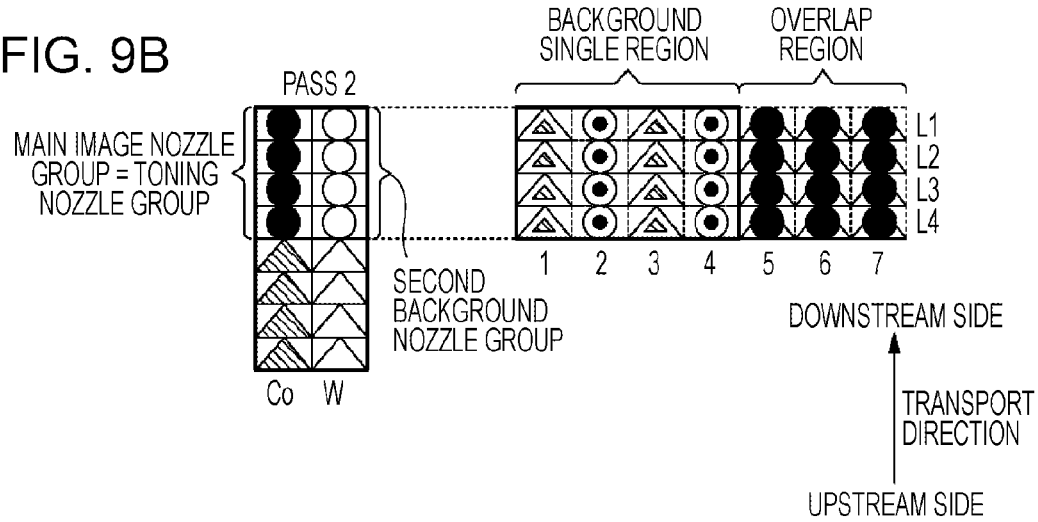

FIGS. 9A and 9B are diagrams that show other forming methods of the toning dot of the background image. In the printing method of the FIG. 7 mentioned above, even in the pixel where the second background nozzle group (○) having the position in the transport direction deviated from the toning nozzle group forms the dots of white ink, the toning nozzle group forms the toning dots. For that reason, the pass where the second background nozzle group forms the dots of white ink is different from the pass where the toning nozzle group forms the toning dots.

However, the pass where the second background nozzle group forms the dots of white ink may be the same as the pass where the toning nozzle group forms the toning dots, without being limited thereto. For that reason, as shown in FIG. 9A, the toning nozzle group forms the toning dots (diagonal triangles) only in the pixel having odd numbered horizontal positions in the pass where the first background nozzle group forms the dots (Δ) of white ink in the pixel of odd numbered horizontal positions. Moreover, as shown in FIG. 9B, the main image nozzle group forms the toning dots (black circles) in the pixel having even numbered horizontal positions, in the pass where the second background nozzle group forms the dots (○) of white ink in the pixel having even numbered horizontal positions. That is, in the front printing mode, the first background nozzle group ejects ink from the nozzles (toning nozzle group) of the color nozzle row Co aligned with the first background nozzle group in the movement direction to the pixel forming the dots of white ink to form the toning dots, and the second background nozzle group ejects ink from the main image nozzle group to the pixel forming the dots of white ink to form the toning dots.

In this way, by causing the main image nozzle group to take charge of a part of the role of the toning nozzle group, the dots of the background image white ink and the toning dots can be formed to overlap in the same pass. As a consequence, the dots of white ink are mixed with the toning dots, whereby the granular quality of the dot in the background image of the background single region can be further improved.

Figure 10:
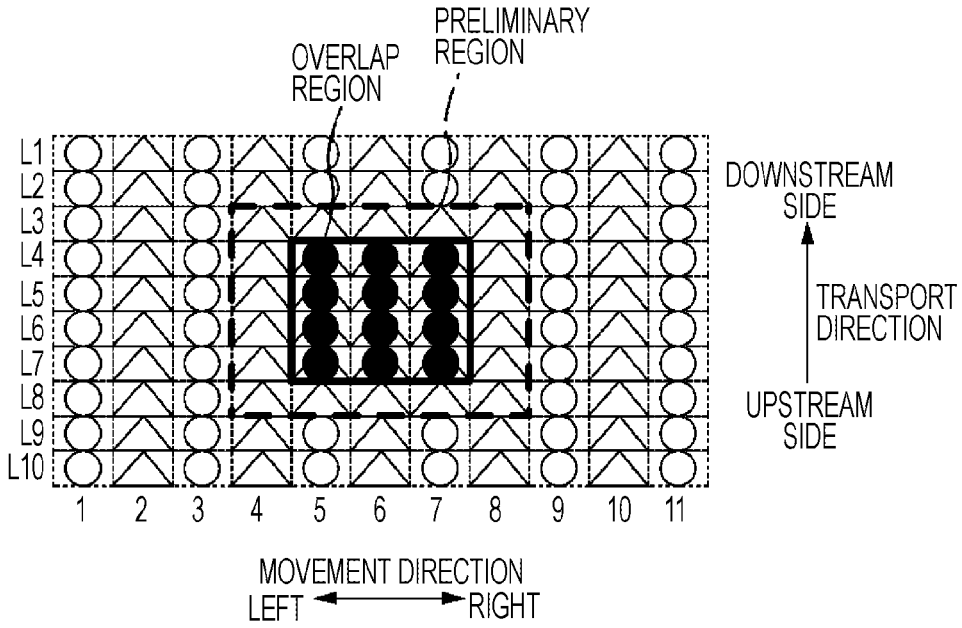
FIG. 10 is a diagram that describes a preliminary region around the overlap region.

FIG. 10 is a diagram that describes a preliminary region around the overlap region. In the printing method of FIG. 7 mentioned above, the background single region is formed from the pixel (for example, pixels of horizontal positions 4 and 8) adjacent to the pixel where the main image is printed. That is, the overlap region and the background single region are adjacent to each other. Moreover, in the pixel adjacent to the pixel where the main image is printed, the dots are formed by the second background nozzle group aligned with the main image nozzle group in the movement direction in the pass where the main image is printed. Usually, at most, dots larger than the area of one pixel are formed. Particularly, since the background image is a solid image, the dots larger than the area of one pixel are formed. For that reason, similarly to the printing method of FIGS. 7A to 7C, when the dots are formed in the pixel where the main image is formed and in the pixel adjacent to the pixel where the main image is formed in the same pass, the background image dots are mixed with the main image dots, whereby the printing image (particularly, the outline of the main image) bleeds.

Accordingly, a "preliminary region" is provided around the pixel where the main image is printed, that is the pixel belonging to the overlap region. Moreover, the background image of the preliminary region is formed only by the first background nozzle group having the positions in the transport direction deviated from those of the main image nozzle group, similarly to the background image of the overlap region. That is, ink is ejected from one nozzle group of the first background nozzle group and the second background nozzle group to the pixel which forms the background image and is situated around the pixel belonging to the overlap region, depending on the printing mode. In so doing, the background image dot is formed in the pixel adjacent to the pixel, where the main image is formed, in the pass different from the pass where the main image dot is formed. For that reason, it is possible to prevent the background image dot and the main image dot being mixed with each other and the printing image gets blurred. In addition, although one pixel around the overlap region is the preliminary region in FIG. 10, a plurality of pixels around the overlap region may be the preliminary regions without being limited thereto.

Figure 11:
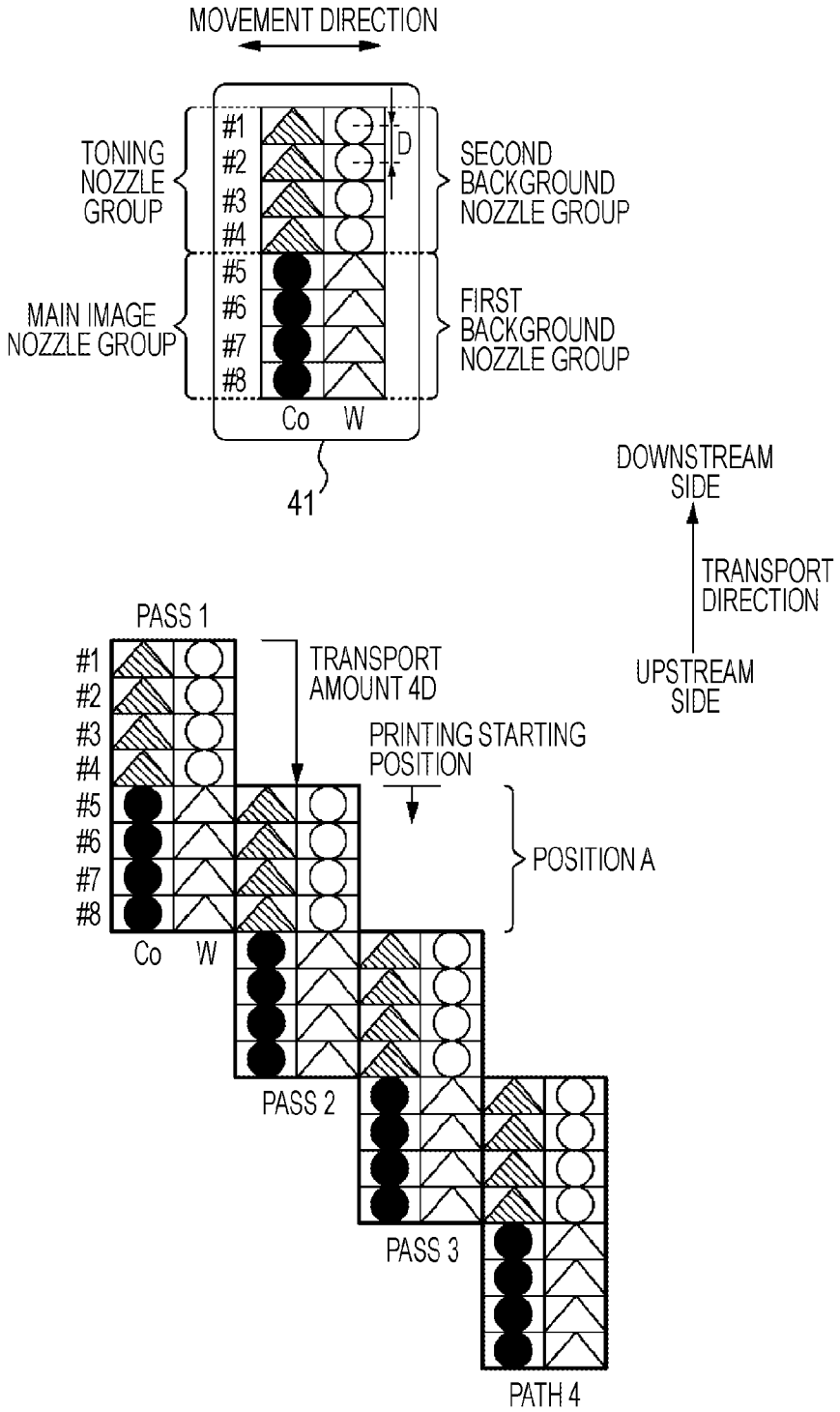
FIG. 11 is an explanatory diagram of first print pattern in a back printing mode.

FIG. 11 is an explanatory diagram of the first printing pattern in the back printing mode. In the back printing mode, on the contrary to the front printing mode (FIG. 6), as shown in an upper diagram of FIG. 11, half the nozzles (#1 to #4) on the downstream side of the transport direction of the color nozzle row Co are a toning nozzle group, and half of the nozzles (#5 to #8) on the upstream side of the transport direction of the color nozzle row Co are a main image nozzle group. Moreover, in regard to the white nozzle row W, similarly to the front printing mode, half the nozzles (#1 to #4) on the downstream side of the transport direction are a second background nozzle group, and half of the nozzles (#5 to #8) on the upstream side of the transport direction are a first background nozzle group. That is, in the back printing mode (corresponding to the second mode), the main image is formed by the main image nozzle group which is the nozzles of the color nozzle row Co aligned with the first background nozzle group on the upstream side of the transport direction in the movement direction, and the background image of the overlap region is formed by the second background nozzle group on the downstream side of the transport direction.

In so doing, as shown in a lower diagram of FIG. 11, firstly, the position A on the medium in the transport direction faces the main image nozzle group and the first background nozzle group in the pass 1. At this time, the main image nozzle group forms the main image dots in the pixel belonging to the overlap region, and the first background nozzle group forms the background image dots in a partial pixel of the background single region. After that, the medium is transported to the transport direction downstream side by the half length 4D of the nozzle row, whereby the position A on the medium in the transport direction faces the toning nozzle group and the second background nozzle group in pass 2. At this time, the second background nozzle group forms the dots in the pixel, where the dots by the first background nozzle group are not formed, and in the pixel belonging to the overlap region among the pixels belonging to the background single region. In addition, the toning nozzle group forms the dots in the pixel belonging to the background single region. As a consequence, the background image is printed on the main image, and it is possible to relatively lengthen the time from when the main image is formed to when the background image of the overlap region is formed, whereby the blur of the image can be prevented.

In this manner, in the present embodiment, in order to form the background image of the overlap region, ink is ejected from one nozzle group of the first background nozzle group and the second background nozzle group to the pixel belonging to the overlap region depending on the printing mode to form the dots. In so doing, the main image and the background image can be formed to overlap. Furthermore, it is possible to make the pass forming the main image different from the pass forming the background image of the overlap region.

In addition, even in the back printing mode, the first background nozzle group may eject ink from the main image nozzle group to the pixel forming the dots of white ink to form the toning dots, and the second background nozzle group may eject ink from the nozzles (the toning nozzle group) of the color nozzle row Co aligned with the second background nozzle group in the movement direction to the pixel forming the dot of white ink to form the toning dots. In so doing, it is possible to form the dots of the background image white ink and the toning dots to overlap in the same pass. As a consequence, the dots of the white ink are mixed with the toning dots, whereby it is possible to improve the granular quality of the dots in the background image in the background single region.

Second Printing Pattern

Figure 12:
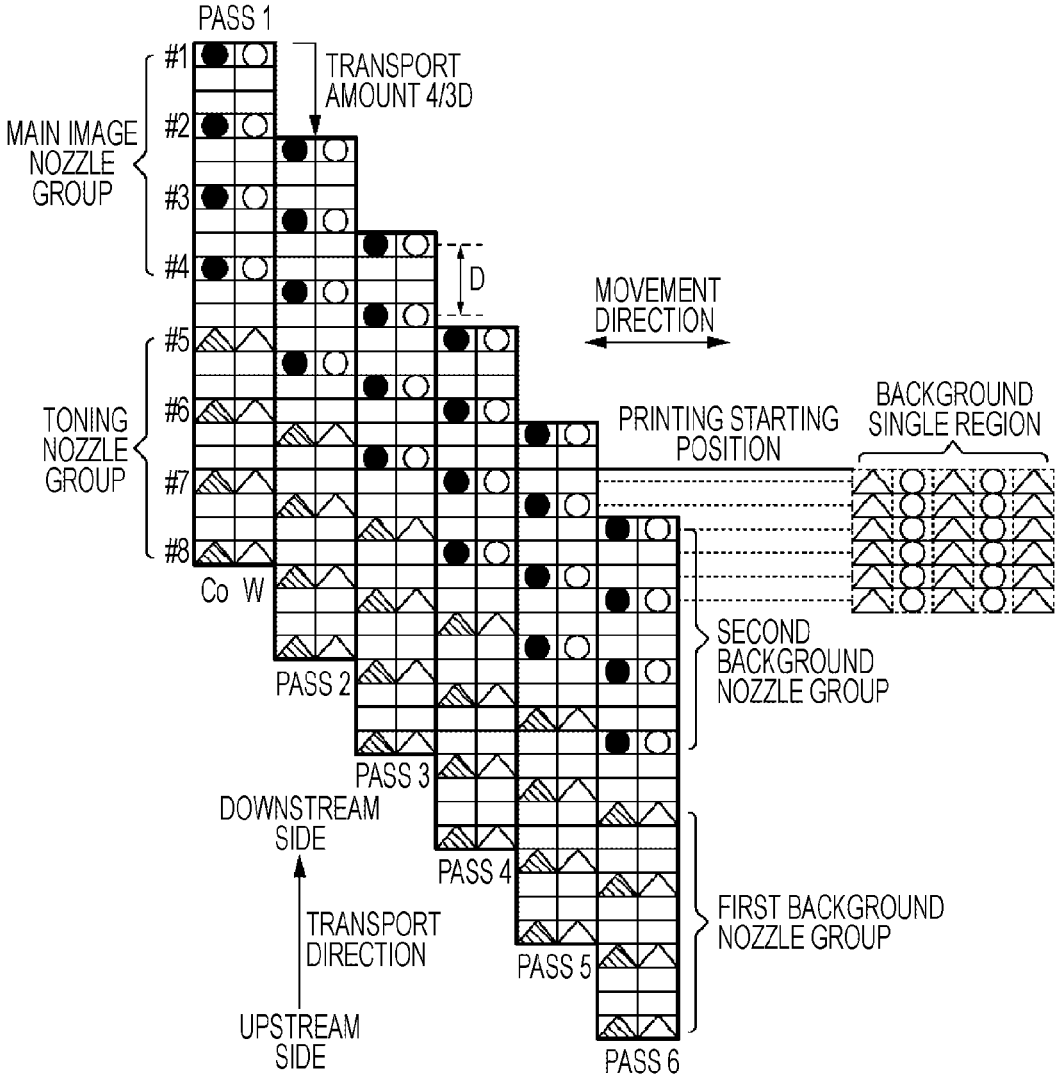
FIG. 12 is an explanatory diagram of second print pattern in a front printing mode.

FIG. 12 is an explanatory diagram of a second printing pattern in the front printing mode. The second printing pattern has the same nozzle configuration as the first printing pattern (FIG. 6). That is, half the nozzles (#1 to #4) on the downstream side of the transport direction of the color nozzle row Co are a main image nozzle group, and nozzles (#5 to #8) of a half on the upstream side of the transport direction thereof are a toning nozzle group. Moreover, half the nozzles (#1 to #4) on the downstream side of the transport direction of the white nozzle row W are a second background nozzle group, and half of the nozzles (#5 to #8) on the upstream side of the transport direction thereof are a first background nozzle group.

The second printing pattern is a printing method (an interlace printing) of forming a raster line in another pass between raster lines formed in any pass. For example, the background image raster lines are formed in pass 2 and pass 3 between the background image raster lines formed in the nozzles #7 and #8 in pass 1. For that reason, in the second printing pattern, the medium transport amount is shorter than that of the first printing pattern (the band printing) shown in FIG. 6 by 4D/3. In the second printing pattern that is the interlace printing, the printing resolution in the transport direction becomes higher than that of the first printing pattern that is the band printing.

Furthermore, even in the second printing pattern, similarly to the first printing pattern, the first background nozzle group forms the background image dots (Δ) in a part of the pixels belonging to the background single region, and the second background nozzle group forms the background image dots (○) in another part (the remaining part) of the pixels belonging to the background single region. In so doing, deterioration in the image quality of the background image of the background single region can be suppressed.

Third Printing Pattern

Figure 13:
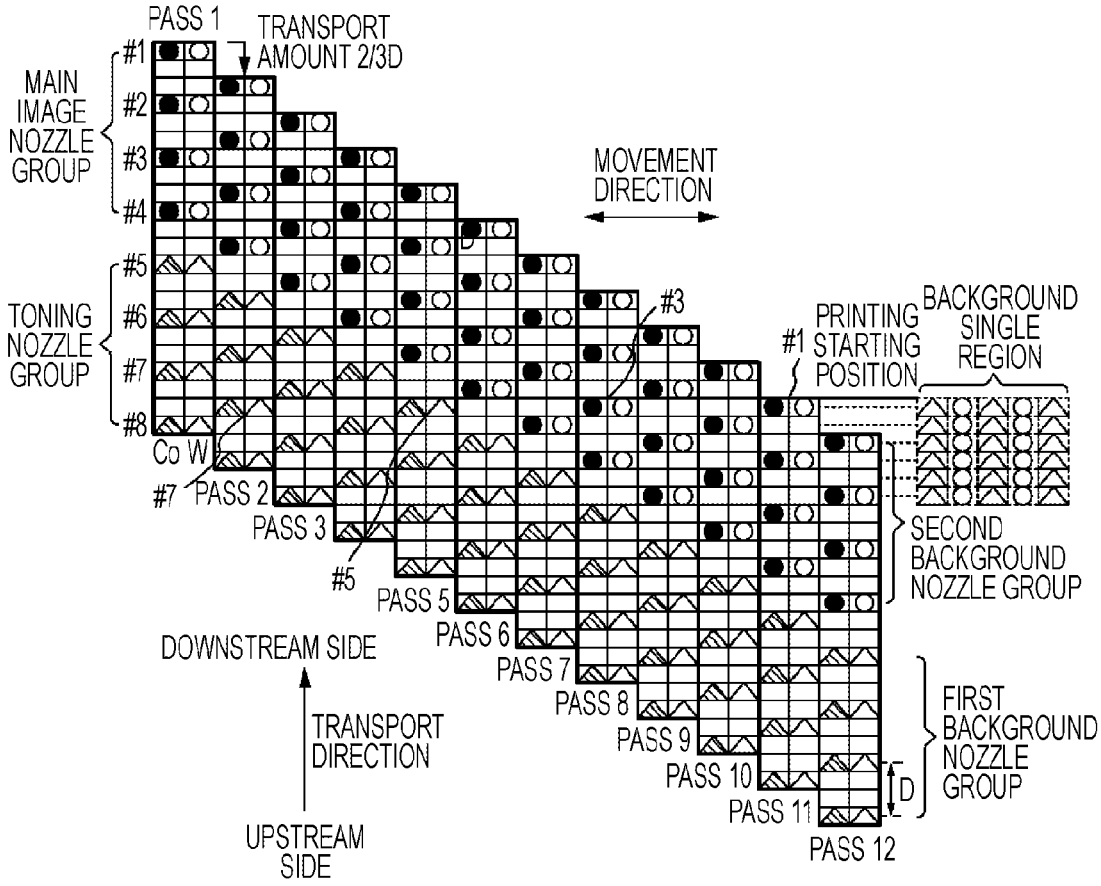
FIG. 13 is an explanatory diagram of third print pattern in a front printing mode.

FIG. 13 is an explanatory diagram of a third printing pattern in the front printing mode. The third printing pattern also has the same nozzle configuration as that of the first printing pattern (FIG. 6). The third printing pattern is a printing method of causing two nozzles of each nozzle group to face one pixel and is a so-called overlap printing. For that reason, in the third printing pattern, the medium transport amount is shorter than that of the first printing pattern or the second printing pattern by 2D/3.

For example, the nozzle #7 of the first background nozzle group and the toning nozzle group of pass 2, the nozzle #5 of the first background nozzle group and the toning nozzle group of pass 5, the nozzle #3 of the main image nozzle group and the second background image group of pass 8, and the nozzle #1 of the main image nozzle group and the second background image nozzle group of pass 11 can be allocated to the raster line immediately below the printing start position.

Accordingly, in the third printing pattern, the raster lines each constituting the background image or the main image of the overlap region in addition to the background image of the background single region can be formed by two nozzles. As a consequence, it is possible to suppress deterioration in the image quality of the background image or the main image of the overlap region.

Furthermore, the raster lines constituting the background image of the background single region can be formed by four nozzles. For example, when four nozzles allocated to the raster lines constituting the background image of the background single region forms the dots in the pixels of four gaps aligned in the movement direction, deterioration in the image quality can be further relived. In addition, among the four nozzles to be allocated to the raster lines constituting the background image of the background single region, two nozzles (Δ) belonging to the first background nozzle group may form the dots to overlap in the same pixel (for example, the even number pixel), and two nozzles (○) belonging to the second background nozzle group may form the dots to overlap in the same pixel (for example, the odd number pixel). In this case, it is possible to deeply print the density of the background image of the background single region, while relieving deterioration in the image quality of the background image of the background single region.

Fourth Printing Pattern

Figure 14:
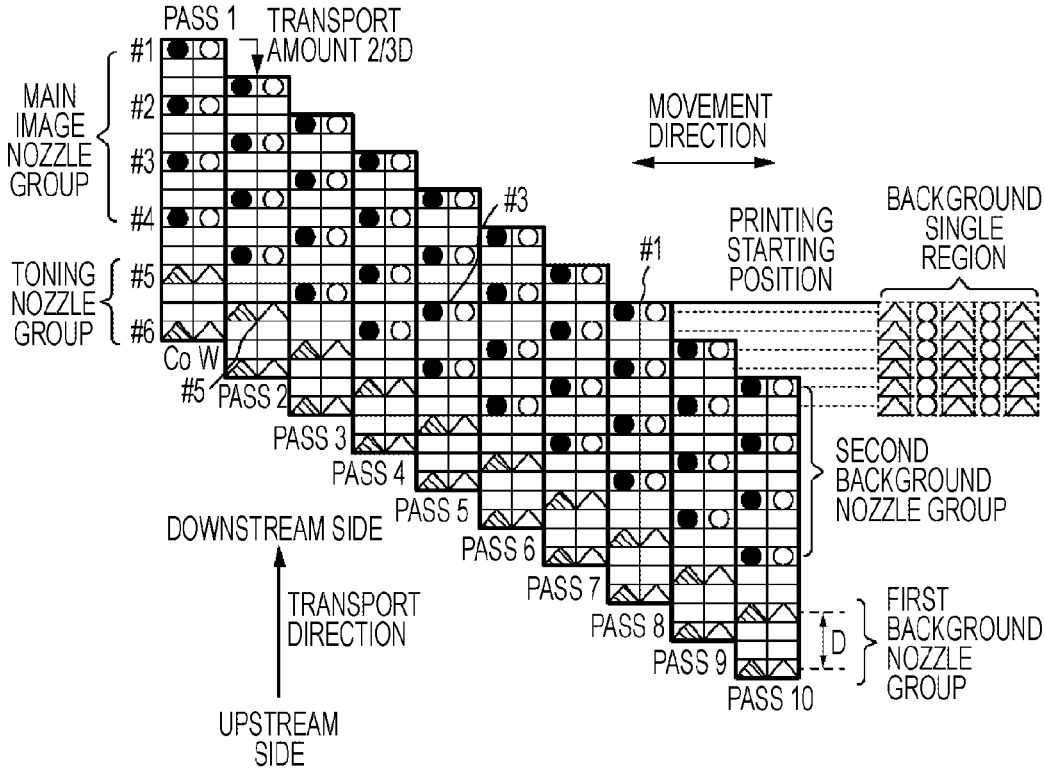
FIG. 14 is an explanatory diagram of fourth print pattern in a front printing mode.

FIG. 14 is an explanatory diagram of a fourth printing pattern in the front printing mode. In the fourth printing pattern, the number of nozzles belonging to the first background nozzle group deviated from the main image nozzle group in the transport direction is reduced further than the number of nozzles belonging to the main image nozzle group. In FIG. 14, the number of nozzles belonging to each of the color nozzle row Co and the white nozzle row W is six. Moreover, among the color nozzle row Co, four nozzles (#1 to #4) on the downstream side of the transport direction are the main image nozzle group, and two nozzles (#5 and #6) on the upstream side of the transport direction are the toning nozzle group. Furthermore, among the white nozzle row W, four nozzles (#1 to #4) on the downstream side of the transport direction are the second background nozzle group, and two nozzles (#5 and #6) on the upstream side of the transport direction are the first background nozzle group.

In this case, for example, the nozzle #5 of the first background nozzle group and the toning nozzle group of pass 2, the nozzle #3 of the main image nozzle group and the second background image nozzle group of pass 5, and the nozzle #1 of the main image nozzle group and the second background nozzle group of pass 8 can be allocated to the raster line immediately below the printing start position. Accordingly, in the fourth printing pattern, similarly to the third printing pattern (FIG. 13), the raster lines constituting the main image can be formed by two nozzles (●), whereby, it is possible to suppress deterioration in the image quality of the main image.

Meanwhile, since the number of nozzles belonging to the first background nozzle group is reduced further than the number of nozzles belonging to the main image nozzle group, the nozzle (Δ) of the first background nozzle group to be allocated to one raster line is one. However, the background image of the background single region can be formed by the use of the nozzles of the first background nozzle group as well as the nozzles of the second background nozzle group. Thus, even if the number of nozzles belonging to the first background nozzle group is reduced further than the number of nozzles belonging to the main image nozzle group, the raster lines constituting the background image of the background single region can be formed by three nozzles (Δ and O).

For example, when three nozzles capable of forming the raster lines constituting the background image of the background single region form the dots in the pixels of three gaps aligned in the movement direction, deterioration in the image quality can be further relived. In addition, two nozzles of three nozzles capable of forming the raster lines configuring the background image of the background single region may form the dots to overlap in a part of the pixels aligned in the movement direction, and the remaining one nozzle may form the dots in another part of the pixels aligned in the movement direction. In this case, it is possible to deeply print the density of the background image of the background single region, while relieving deterioration in the image quality of the background image of the background single region.

Furthermore, since the background image of the overlap region is formed only by the nozzles belonging to the first background nozzle group, the nozzle capable of forming the raster line constituting the background image of the overlap region is one. However, since the background image of the overlap region is formed to overlap with the main image, deterioration in the image quality due to the defective nozzle is hardly noticeable, and there is no problem.

In this manner, in the fourth printing pattern, since the number of nozzles belonging to the first background nozzle group is reduced further than that belonging to the main image nozzle group, the number of nozzles belonging to the nozzle row can be reduced. In other words, the number of nozzles belonging to the main image nozzle group can be increased as much as the number of nozzles belonging to the first background nozzle group is reduced.

Fifth Printing Pattern

Figure 15:
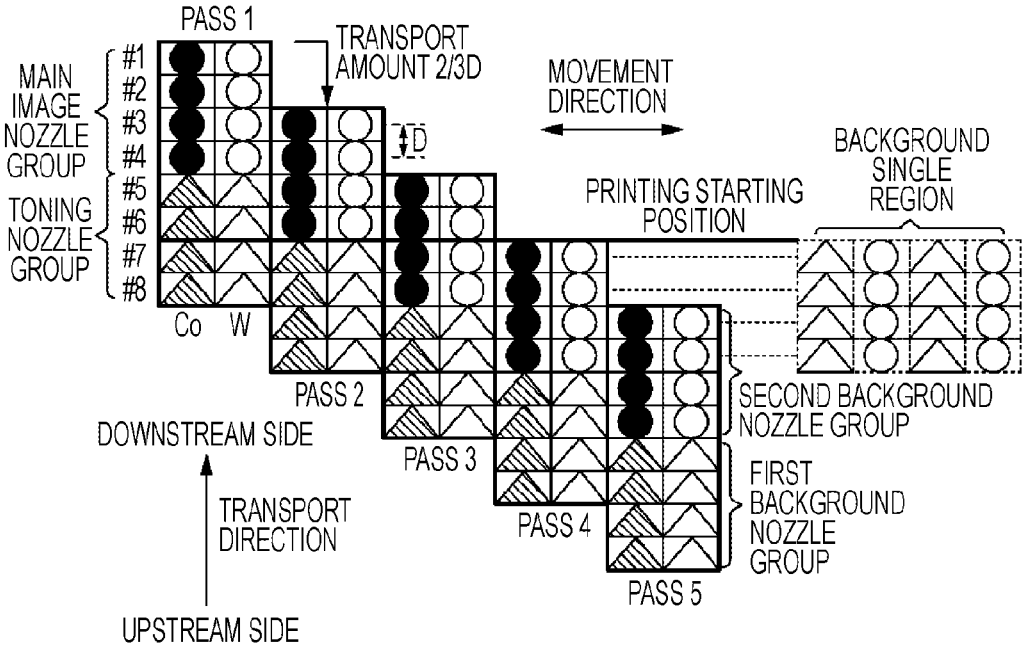
FIG. 15 is an explanatory diagram of fifth print pattern in a front printing mode.

FIG. 15 is an explanatory diagram of a fifth printing pattern in the front printing mode. FIG. 15 is a diagram that describes the printing method of a case where the nozzle distance D in the transport direction in the nozzle row is short. In addition, the fifth printing pattern has the same nozzle configuration of the first printing pattern (FIG. 6).

When the head 41 having the short nozzle distance D is used to perform the printing, it is possible to perform the printing with a high print resolution in the transport direction, without forming the raster line in another pass between the raster lines formed in a certain pass as in the second printing pattern to the fourth printing pattern (FIG. 12 to FIG. 14). Furthermore, in the fifth printing pattern, the medium transport amount is shorter than that of the first printing pattern (FIG. 6). Therefore, similarly to the third printing pattern, the raster lines each constituting the main image and the background image can be formed by two nozzles, whereby deterioration in the image quality due to the defective nozzle can be suppressed.

As mentioned above, the description of the first to fifth printing patterns of forming the main image and the background image to overlap is ended. In addition, a bidirectional printing may be used in which the head 41 forms the image during outward path of being moved to one side of the movement direction, and the head 41 also forms the image during return path of being moved to the other side of the movement direction, and a unidirectional printing may be used which forms the image only in any one time of the outward path and the return path.

Furthermore, in the present embodiment, the printer driver makes the printing data which ejects fluid from the main image nozzle group to the pixel of the overlap region, ejects fluid from the first background nozzle group to a part of the pixels of the background single region, and ejects fluid from the second background nozzle group to another part of the pixel of the background single region. The controller 10 of the printer 1 controls the head unit 40 and the like based on the printing data. Thus, the controller 10 of the printer 1 and the computer 60 which installed the printer driver correspond to the "control portion", and a printing system to which the printer 1 and the computer 60 are connected corresponds to the "fluid ejecting apparatus". However, the controller 10 of the printer 1 may take charge of the role of the printer driver, without being limited thereto. In this case, the controller 10 of the printer 1 corresponds to the "control portion" and the printer 1 single body corresponds to the "fluid ejecting apparatus".

MODIFIED EXAMPLE

Figure 16:
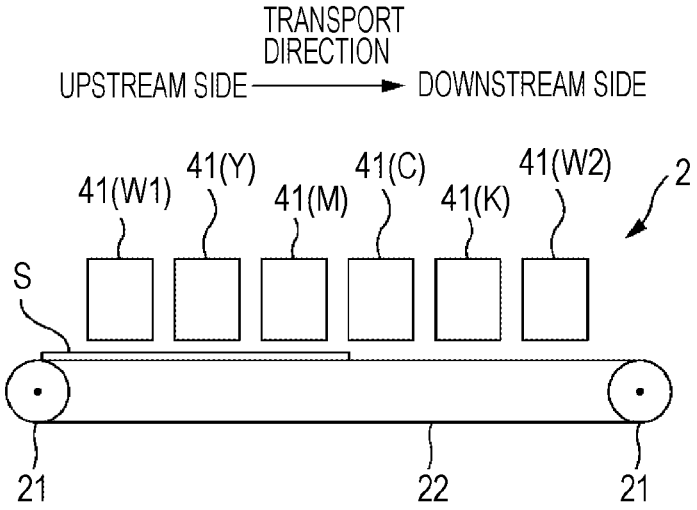
FIG. 16 is a cross-sectional view of a printer different from the embodiment mentioned above.

FIG. 16 is a cross-sectional view of a printer 2 different from the aforementioned embodiment. Up to here, as shown in FIG. 2, the printer 1 is exemplified in which an operation of forming the image while the head 41 (FIG. 3) is moved in the movement direction and an operation of transporting the medium in the transport direction are alternately repeated, but the printer is not limited thereto. As shown in FIG. 16, a printer 2 may be adopted which transports the medium S under a plurality of fixed heads 41 by the transport belt 22 rotated by the transport roller 21.

In the printer 2 of the modified example, a first white head 41 (W1) ejecting the white ink, a yellow head 41(Y) ejecting the yellow ink, a magenta head 41(M) ejecting the magenta ink, a cyan head 41(C) ejecting the cyan ink, a black head 41(K) ejecting the black ink, and a second white head 41(W2) ejecting the white ink are sequentially aligned from the upstream side in the transport direction.

In such a printer 2, in the case of printing the main image and the background image to overlap in the front printing mode, firstly, the first white head 41(W1) forms a partial dot constituting the background image of the background single region, and all the dots constituting the background image of the overlap region. After that, each of the four color ink heads 41 forms all the dots constituting the main image. Moreover, finally, the second white head 41(W2) forms the remaining dot constituting the background image of the background single region.

On the contrary, in the case of printing the main image and the background image to overlap in the back printing mode, firstly, the first white head 41(W1) forms a partial dot constituting the background image of the background single region. After that, each head 41 of the four color ink forms all the dots constituting the main image. Moreover, finally, the second white head 41(W2) forms the remaining dot constituting the background image of the background single region and the entire dot constituting the background image of the overlap region.

In so doing, it is possible to print the main image and the background image to overlap in order depending on the mode. Furthermore, in order to print the background image of the background single region, since the first white head 41(W1) and the second white head 41(W2) form the dots in the different positions of the pixels each belonging to the background single region, deterioration in the image quality can be suppressed.

Furthermore, in the aforementioned embodiment, an example is provided which prints the background image with the color of white adjusted by suitably using the four color inks (CMYK) in the white ink, but the background image may be printed only by the white ink without being limited thereto. In addition, the background image may be printed by the color ink (for example, a metallic-based ink) other than the white ink without being limited to the white background image. Furthermore, in the aforementioned embodiment, the main image is printed using only the four color inks (CMYK), but the main image may be printed using the white ink (the background image ink) together with the four color inks, without being limited thereto. It is possible to print the image in which colors of high brightness and high chroma are reproduced by adding the white ink to the four color inks to print the main image.

Furthermore, in the aforementioned embodiment, the main image and the background image are printed to overlap, but not limited thereto. For example, the background image may be printed only around the main image. That is, only the background image is printed in the background single region shown in FIG. 5B, and only the main image is printed in the overlap region. Even in this case, in order to print the background image of the background single region, the dots are each formed in the pixels of different positions, in the first background nozzle group situated on the upstream side of the transport direction and the second background nozzle group situated in the transport direction downstream side. As a consequence, deterioration in the image quality of the background image can be suppressed.

Figure 17A:
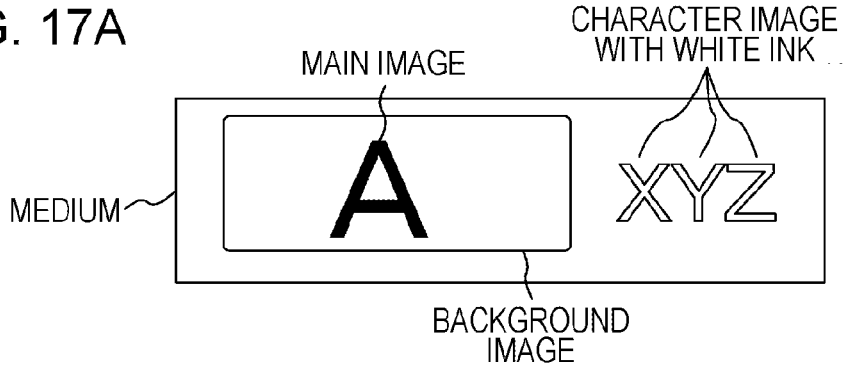
FIGS. 17A to 17C are diagrams that describe modified examples of an image printed on a medium.
Figure 17B:
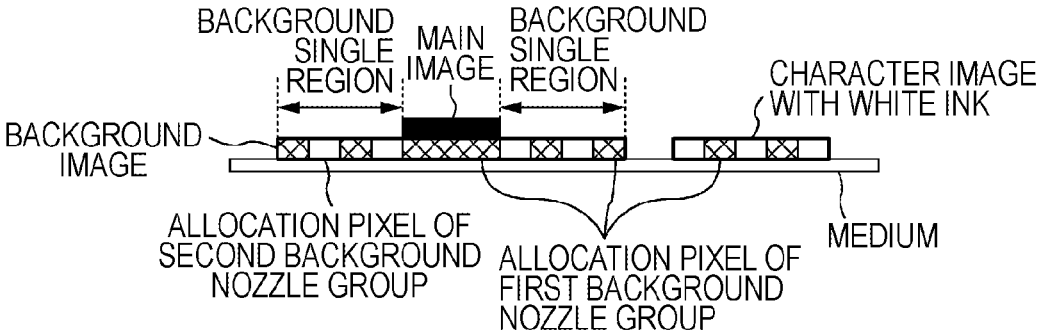

FIGS. 17A and 17B are diagrams that describe modified examples of the image to be printed on the medium. In the embodiments mentioned above, an example is provided which prints the image (FIG. 5) in which the main image and the background image are overlapped. That is, the white ink is used just to print the background image, but not limited thereto. For example, as shown in FIG. 17A, the image (white letters in FIG. 17A, corresponding to the image by fluid forming the background image) by white ink may be printed on the medium together with the white image. Particularly, the image by white ink may be printed on the colored medium or the transparent medium.

Similarly to the background image of the background single region, the image by the white ink is also not printed to overlap with the main image. For that reason, it is possible to print the image by the white ink by the use of the second background nozzle group (example: nozzles #1 to #4 of the white nozzle row W of FIG. 6) aligned with the main image nozzle group in the movement direction as well as the first background nozzle group (example: nozzles #5 to #8 of the white nozzle row W of FIG. 6) deviated from the main image nozzle group (example: nozzles #1 to #4 of the color nozzle row Co of FIG. 6) in the transport direction.

Thus, similarly to the background image of the background single region, the image of the white ink is formed in two passes, the dots of the first background nozzle group are formed on a part of the pixels belonging to the region (corresponding to the second region) forming the image of the white ink, and the dots of the second background nozzle group are formed on another part of the pixels belonging to the region forming the image of the white ink. In so doing, it is possible to form the raster line constituting the image of the white ink by two other nozzles, whereby it is possible to suppress deterioration in the image quality due to the defective nozzle.

Particularly, when the image, in which the main image and the background image are overlapped, and the image of white ink are aligned in the movement direction, that is, when two images are printed in the same pass, the transport amount of the medium needs to have, for example, the length of a half of the nozzle row to match the image in which the main image and the background image are overlapped. However, as in the modified example, by printing the image of the white ink using the first background nozzle group and the second background nozzle group, the white nozzle row W can be effectively used, whereby deterioration in the image quality of the image can be suppressed.

Furthermore, in the embodiments mentioned above, an example is provided which prints the image (FIG. 5) having the background image larger than the main image, that is, the image having a part (the background image of the background single region) of the background image which does not overlap with the main image, but not limited thereto. As shown in FIG. 17B, the image having the same size of main image and background image and image of the white ink may be printed on the medium.

Figure 18A:
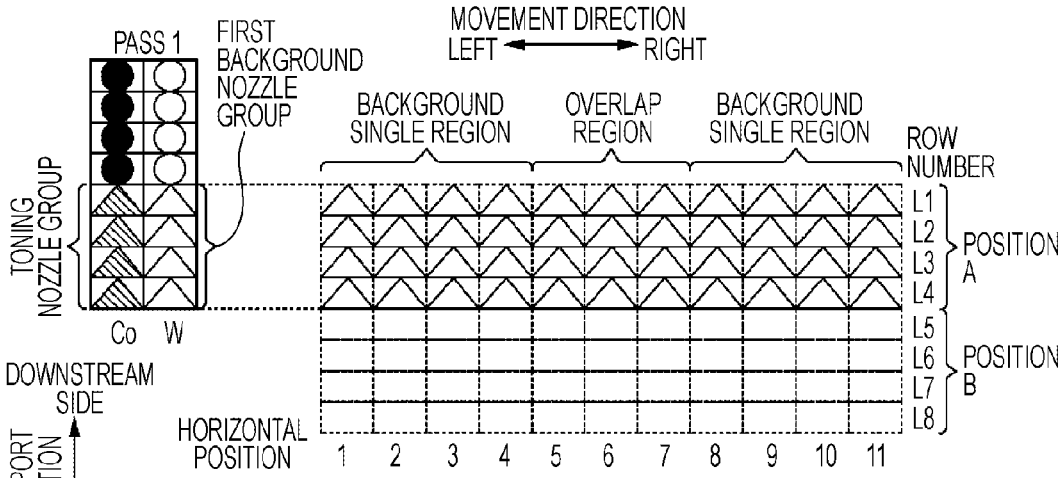
FIGS. 18A to 18C are diagrams that describe modified examples of a print pattern of a background single region.
Figure 18B:
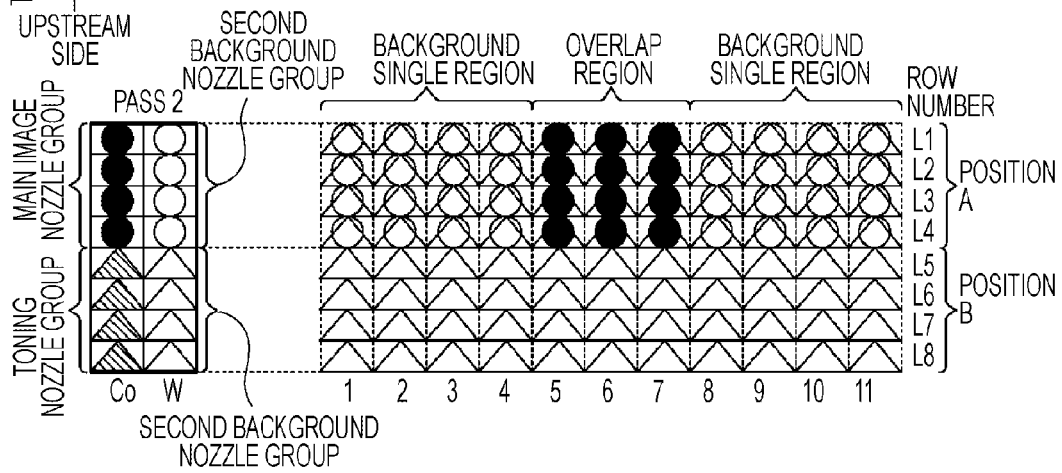
Figure 18C:
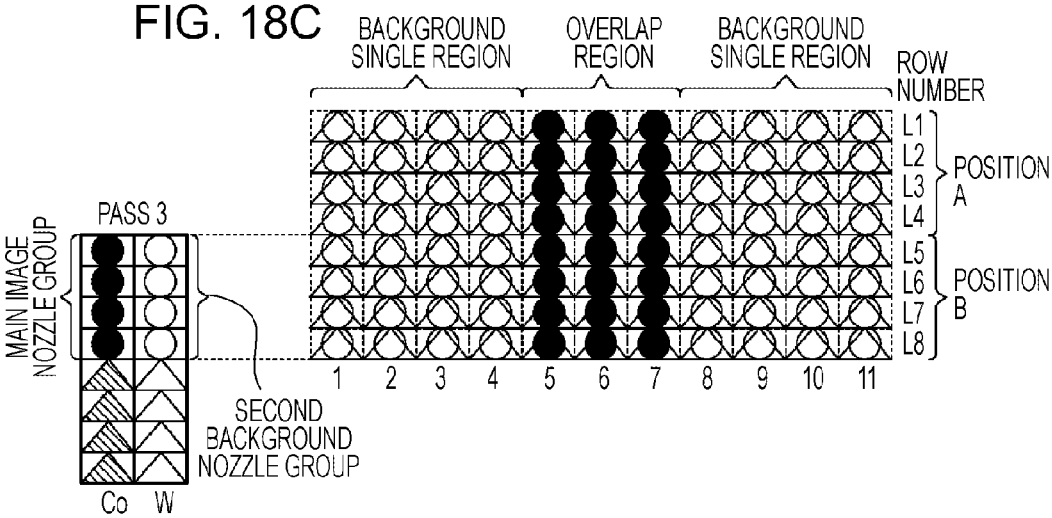

FIGS. 18A to 18C are diagrams that describe modified examples of the printing pattern of the background single region. In the aforementioned embodiment (FIG. 7), the first background nozzle group forms the dots (Δ) in the pixel of the odd number among the pixel belonging to the background single region, and the second background nozzle group forms the dots (○) in the pixel of the even number among the pixels belonging to the background single region. That is, the first background nozzle group and the second background nozzle group print the pixels aligned in the movement direction while thinning the dots, but not limited thereto.

Figure 17C:
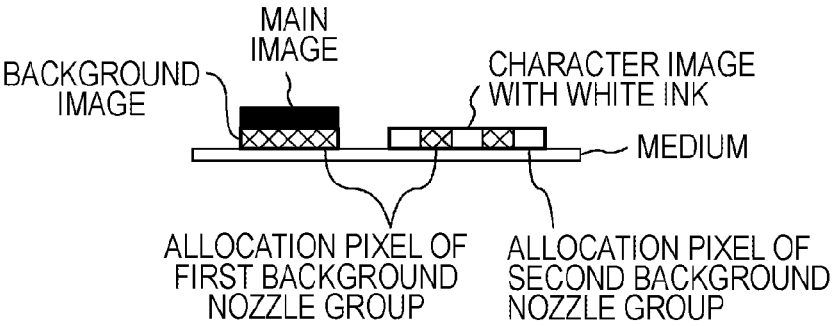

The background image is usually a solid image, and is applied with the white ink without gap so as to print the background image. Particularly, when the background image or the image of the white ink shown in FIG. 17 is printed on the medium of a deep color (for example, black), there is a fear that the density (density of white) of the image is thin only by the printing in the one pass and the visibility of the image declines. Furthermore, since the background image of the background single region or the image of white ink is not printed to overlap with the main image but is directly viewed, the image needs to be printed at an image quality (density) higher than the background image of the overlap region.

Thus, as shown in FIG. 18A, in pass 1, the first background nozzle group (the nozzle group deviated from the main image nozzle group in the transport direction) forms the dots (Δ) in all the pixels belonging to the background single region and the overlap region. Moreover, as shown in FIG. 18B, in pass 2, the second background nozzle group (the nozzle group aligned with the main image nozzle group in the movement direction) forms the dots (○) in all the pixels belonging to the background single region. That is, in the pixel belonging to the background single region, the dot formed by ejecting ink from the first background nozzle group and the dot formed by ejecting ink from the second background nozzle group are formed to overlap.

In doing so, it is possible to print the background image of the background single region in the image in which the medium is satisfactorily buried by the white ink, at a high density. Furthermore, since one raster line constituting the background image of the background single region can be formed by other two nozzles, it is possible to suppress deterioration in the image quality of the image due to the defective nozzle. According to such a printing pattern, the background image of the background single region can be printed at a high quality. In addition, the image of the white ink shown in FIG. 17 as well as the background image of the background single region may also print the dots by the first background nozzle group and the dots by the second background nozzle group to overlap, as shown in FIG. 18.

Other Embodiments

The respective embodiments mentioned above mainly described the printing system having the ink jet printer, but the disclosure of the printing method and the like is also included. Furthermore, the embodiments mentioned above are to facilitate the understanding of the invention but are not intended to interpret the invention in a limited manner. It is needless to say that the invention can be modified and improved without departing from the gist thereof, and the equivalents thereof are included in the invention.

White

In the present specification, "white" includes colors called white by social norms, such as a so-called "whitish color", without being limited to white in the strictest sense which is a surface color of an object reflecting 100% of all visible light wavelengths. "White" refers to, for example, (1) a color in the color range indicated by an index mark in the Lab system on the circumference of a radius 20 on the A*b* plane and on the inside thereof, and L* by 70 or greater when performing colorimetry in colorimetry mode: spot colorimetry, light source: D50, backing: Black, and print medium: transparent film using a colorimeter eye-one Pro manufactured by x-rite Company, (2) a color in a color range indicated by a mark in the Lab system on the circumference of a radius 20 on the A*b* plane and the inside thereof and L* by 70 or greater when performing colorimetry in measurement mode D502° view, SCF mode, and white back using a colorimeter CM2022 manufactured by Minolta Co., Ltd, or (3) a color of ink used as the background of the image as described in JP-A-2004-306591. White is not limited to pure white if being used as the background.

Printer

In the embodiments mentioned above, the printer 1 is provided as an example which repeats the operation of forming the image on the medium while moving the head 41 in the movement direction, and the operation of transporting the medium to the head 41 in the transport direction, but not limited thereto. For example, a printer may be adopted which repeats an operation of forming the image while moving the head unit having (a plurality of) heads in the medium transport direction, and an operation of moving the head unit in the paper width direction to form the image on the paper transported to the print region, and then, transports a medium portion not yet printed to the print region to form the image again.

Furthermore, the fluid ejecting method from the nozzle may be a piezoelectric method which applies voltage to a driving element (piezoelectric element) and expands and extracts a pressure chamber to eject fluid, and may be a thermal method which generates air bubbles in the nozzles using a heating element to eject fluid by the air bubbles.

Fluid Ejecting Apparatus

Although the printer 1 is described in the embodiment mentioned above, it is possible to embody a fluid ejecting apparatus which ejects fluids (liquid, or liquefied body in which particles of functional material are dispersed, and a fluid-like body such as a gel) other than ink, without being limited thereto. For example, the same technique as the aforementioned embodiment may be applied to various apparatuses to which an ink jet technique is applied, such as a color filter manufacturing apparatus, a dyeing apparatus, a micromachining apparatus, a semiconductor manufacturing apparatus, a surface machining apparatus, a three-dimensional molding machine, a gas vaporizer, an organic EL manufacturing apparatus (especially, a macromolecular EL manufacturing apparatus), a display manufacturing apparatus, a film forming apparatus, and a DNA chip manufacturing apparatus. Furthermore, such a method or a manufacturing method is within a category of an application range.

Ink and Medium

As a (recording) medium used in the printer 1, ink (a UV ink) may be used which is cured upon irradiating ultraviolet-rays, and in the case of using UV ink, it need not be a medium having ink absorbency. However, there is a need for an irradiator that irradiates ultraviolet-rays.

Besides, as the (recording) medium used in the printer 1, a medium having the ink absorbency can be adopted. Ink to be absorbed to the medium having the ink absorbency includes "a water-based ink" at least including water as a solvent. In addition, as the color inks (CMY) or the black ink (K) as such a composition, for example, ink described in JP-A-2008-81693, JP-A-2005-105135, and JP-A-2003-292834 can be adopted. Furthermore, as the white ink (W), for example, ink described in JP-A-2009-138078 and JP-A-2009-137124 can be adopted.

The medium absorbing the water-based ink includes, for example, a medium such as paper cloth that uses a base material absorbing ink, and a medium in which an ink absorbent layer absorbing ink is provided in a base material absorbing ink or a base material not absorbing ink. The material of the base material includes, for example, a resin film such as a polyester film, a polyolefin film, or polyvinyl chloride, a paper such as a plain paper, a coated paper, or a tracing paper, a resin coated paper or a synthetic paper. In addition, the medium having transparency includes, for example, a medium described in JP-A-2009-925, JP-A-9-99634, and JP-A-9-208870.

What is claimed is:

1. A fluid ejecting apparatus comprising:

a main image nozzle group comprising one or more colored nozzle groups, wherein each colored nozzle group comprises nozzles and is configured to eject fluid of a single color, wherein the main image nozzle group ejects fluid onto a medium to thereby form a main image;

a background image nozzle group comprising nozzles, wherein the background image nozzle group ejects fluid onto the medium to thereby form a background image, wherein the background image comprises a first portion that does not overlap the main image, and a second portion that overlaps the main image; and a control portion which performs a dot forming operation which forms an image by ejecting fluid from the nozzles onto the medium to form dots;

wherein, in the dot forming operation, the control portion performs control which makes a first number of nozzles per unit area of the medium of the background image nozzle group used for forming of the first portion of the background image greater than a second number of nozzles per unit area of the medium of the background image nozzle group used for forming of the second portion of the background image, such that the fluid of the first portion of the background image has a higher concentration per unit area of the medium than the fluid of the second portion of the background image.

2. The fluid ejecting apparatus according to claim 1, wherein the background image nozzle group comprises a first nozzle group situated to one side in a predetermined direction, and a second nozzle group situated to another side in the predetermined direction, wherein the control portion performs control which ejects fluid from the main image nozzle group to a first region of the medium on which the main image is formed, ejects fluid from the first nozzle group and the second nozzle group to a second region of the medium on which the first portion of the background image is formed, wherein fluid is ejected from the first nozzle group to a part of the second region, and fluid is ejected from the second nozzle group to another part of the second region.

3. The fluid ejecting apparatus according to claim 2, wherein, when forming the main image and the background image to overlap on the medium, in order to form the second portion of the background image, fluid is ejected from one nozzle group of the first nozzle group and the second nozzle group to the first region.

4. The fluid ejecting apparatus according to claim 2, further comprising:

a first nozzle row in which the nozzles for ejecting fluid forming the main image are aligned in the predetermined direction and which has the main image nozzle group; and a second nozzle row in which the nozzles for ejecting fluid forming the background image are aligned in the predetermined direction, and which is aligned with the first nozzle row in a movement direction that is a direction of intersecting the predetermined direction, and has the first nozzle group and the second nozzle group, wherein an image is formed by repeating a dot forming operation of ejecting fluid from the nozzles while relatively moving the first nozzle row, the second nozzle row and the medium in the movement direction, and a transport operation of transporting the relative position of the medium relative to the first nozzle row and the second nozzle row to the other side of the predetermined direction, and wherein the dot forming operation of ejecting fluid from the first nozzle group to the part of the second region is different from the dot forming operation of ejecting fluid from the second nozzle group to the other part of the second region.

5. The fluid ejecting apparatus according to claim 4, wherein, when forming the main image and the background image to overlap on the medium, in a first mode of forming the background image before the main image in the predetermined region of the medium, the main image is formed by the main image nozzle group which has the nozzles of the first nozzle row aligned with the second nozzle group in the movement direction, and the background image of the first region is formed by the first nozzle group, and in a second mode of forming the main image before the background image in the predetermined region of the medium, the main image is formed by the main image nozzle group which has the nozzles of the first nozzle row aligned with the first nozzle group in the movement direction, and the background image of the first region is formed by the second nozzle group.

6. The fluid ejecting apparatus according to claim 5, wherein, in the first mode, fluid is ejected from the nozzles of the first nozzle row aligned with the first nozzle group in the movement direction to the part of the second region, and fluid is ejected from the main image nozzle group to the other part of the second region, and wherein, in the second mode, fluid is ejected from the main image nozzle group to the part of the second region, and fluid is ejected from the nozzles of the first nozzle row aligned with the second nozzle group in the movement direction to the other part of the second region.

7. The fluid ejecting apparatus according to claim 4, wherein fluid is ejected from one nozzle group of the first nozzle group and the second nozzle group to an area around an area which forms the background image in the first region.

8. The fluid ejecting apparatus according to claim 2, wherein the dots to be formed by ejecting fluid from the first nozzle group and the dots to be formed by ejecting fluid from the second nozzle group are formed to overlap in the second region.

9. A liquid ejecting method in which a fluid ejecting apparatus ejects fluid from nozzles to a medium, the fluid ejecting apparatus comprising:

a main image nozzle group comprising one or more colored nozzle groups, wherein each colored nozzle group comprises nozzles and is configured to eject fluid of a single color, wherein the main image nozzle group ejects fluid onto the medium to thereby form a main image; and a background image nozzle group comprising nozzles, wherein the background image nozzle group ejects fluid onto the medium to thereby form a background image, wherein the background image comprises a first portion that does not overlap the main image, and a second portion that overlaps the main image;

the method comprising:

performing a dot forming operation which forms an image by ejecting fluid from the nozzles onto the medium to form dots;

wherein the dot forming operation comprises performing control which makes a first number of nozzles per unit area of the medium of the background image nozzle group used for forming of the first portion of the background image greater than a second number of nozzles per unit area of the medium of the background image nozzle group used for forming of the second portion of the background image, such that the fluid of the first portion of the background image has a higher concentration per unit area of the medium than the fluid of the second portion of the background image.

10. A fluid ejecting apparatus comprising:

a main image nozzle group comprising one or more colored nozzle groups, wherein each colored nozzle group comprises nozzles and is configured to eject fluid of a single color, wherein the main image nozzle group ejects fluid onto a medium to thereby form a main image;

a background image nozzle group comprising nozzles, wherein the background image nozzle group ejects fluid onto the medium to thereby form a background image; and a control portion which performs a dot forming operation which forms an image by ejecting fluid from the nozzles onto the medium to form dots;

wherein, in the dot forming operation, the control portion performs control which makes a first number of nozzles of the background image nozzle group used for forming of the background image greater than a second number of nozzles of each colored nozzle group used for forming of the main image;

wherein the background image nozzle group comprises a first nozzle group situated to one side in a predetermined direction, and a second nozzle group situated to another side in the predetermined direction, wherein the control portion performs control which ejects fluid from the main image nozzle group to a first region of the medium on which the main image is formed, ejects fluid from the first nozzle group and the second nozzle group to a second region of the medium on which the background image is formed and the main image is not formed, wherein fluid is ejected from the first nozzle group to a part of the second region, and fluid is ejected from the second nozzle group to another part of the second region.

11. The fluid ejecting apparatus according to claim 10, wherein, when forming the main image and the background image to overlap on the medium, in order to form a background image portion that is the background image of the first region and overlaps with the main image, fluid is ejected from one nozzle group of the first nozzle group and the second nozzle group to the first region.

12. The fluid ejecting apparatus according to claim 10, further comprising:

a first nozzle row in which the nozzles for ejecting fluid forming the main image are aligned in the predetermined direction and which has the main image nozzle group; and a second nozzle row in which the nozzles for ejecting fluid forming the background image are aligned in the predetermined direction, and which is aligned with the first nozzle row in a movement direction that is a direction of intersecting the predetermined direction, and has the first nozzle group and the second nozzle group, wherein an image is formed by repeating a dot forming operation of ejecting fluid from the nozzles while relatively moving the first nozzle row, the second nozzle row and the medium in the movement direction, and a transport operation of transporting the relative position of the medium relative to the first nozzle row and the second nozzle row to the other side of the predetermined direction, and wherein the dot forming operation of ejecting fluid from the first nozzle group to the part of the second region is different from the dot forming operation of ejecting fluid from the second nozzle group to the other part of the second region.

13. The fluid ejecting apparatus according to claim 12, wherein, when forming the main image and the background image to overlap on the medium, in a first mode of forming the background image before the main image in the predetermined region of the medium, the main image is formed by the main image nozzle group which has the nozzles of the first nozzle row aligned with the second nozzle group in the movement direction, and the background image of the first region is formed by the first nozzle group, and in a second mode of forming the main image before the background image in the predetermined region of the medium, the main image is formed by the main image nozzle group which has the nozzles of the first nozzle row aligned with the first nozzle group in the movement direction, and the background image of the first region is formed by the second nozzle group.

14. The fluid ejecting apparatus according to claim 13, wherein, in the first mode, fluid is ejected from the nozzles of the first nozzle row aligned with the first nozzle group in the movement direction to the part of the second region, and fluid is ejected from the main image nozzle group to the other part of the second region, and wherein, in the second mode, fluid is ejected from the main image nozzle group to the part of the second region, and fluid is ejected from the nozzles of the first nozzle row aligned with the second nozzle group in the movement direction to the other part of the second region.

15. The fluid ejecting apparatus according to claim 12, wherein fluid is ejected from one nozzle group of the first nozzle group and the second nozzle group to an area around an area which forms the background image in the first region.

16. The fluid ejecting apparatus according to claim 10, wherein the dots to be formed by ejecting fluid from the first nozzle group and the dots to be formed by ejecting fluid from the second nozzle group are formed to overlap in the second region.

* * * * *